US006260523B1

(12) United States Patent
Nakamura et al.

(10) Patent No.: US 6,260,523 B1
(45) Date of Patent: Jul. 17, 2001

(54) VARIABLE-VALVE-ACTUATION APPARATUS FOR INTERNAL COMBUSTION ENGINE

(75) Inventors: Makoto Nakamura; Shinichi Takemura; Yoshiaki Miyazato; Yoshihiko Yamada; Tsuneyasu Nohara; Tsutomu Hibi, all of Kanagawa (JP)

(73) Assignees: Unisia Jecs Corporation; Nissan Motor Co., Ltd., both of Kanagawa (JP)

( * ) Notice: Subject to any disclaimer, the term of this patent is extended or adjusted under 35 U.S.C. 154(b) by 0 days.

(21) Appl. No.: 09/498,031

(22) Filed: Feb. 4, 2000

(30) Foreign Application Priority Data

Feb. 5, 1999 (JP) ..... 11-028060
Feb. 15, 1999 (JP) ..... 11-035119

(51) Int. Cl.[7] ..... F01L 1/34

(52) U.S. Cl. ..... 123/90.15; 123/90.16; 123/90.17

(58) Field of Search ..... 123/90.15, 90.16, 123/90.17, 90.22, 90.23, 90.39, 90.6

(56) References Cited

U.S. PATENT DOCUMENTS 4,572,118 * 2/1986 Baguena ..... 123/90.16
5,309,872 * 5/1994 Filippi et al. ..... 123/90.15
5,937,809 * 8/1999 Pierik et al. ..... 123/90.16
5,966,540 * 12/1999 Hara ..... 123/90.16
5,988,125 * 11/1999 Hara et al. ..... 123/90.16
6,019,076 * 2/2000 Pierik et al. ..... 123/90.16
6,029,618 * 2/2000 Hara et al. ..... 123/90.16
6,041,746 * 3/2000 Takemura et al. ..... 123/90.16
6,055,949 * 5/2000 Nakamura et al. ..... 123/90.16
6,123,053 * 9/2000 Hara et al. ..... 123/90.16

FOREIGN PATENT DOCUMENTS 11-107725 4/1999 (JP) .
11-141321 5/1999 (JP) .

OTHER PUBLICATIONS

Ronald J. Pierik and Burak A. Gecim "A Low–Friction Variable–Valve–Actuation Device, Part 1: Mechanism Description and Friction Measurements" 1997 Society of Automotive Engineers, Inc., pp. 81–87.

* cited by examiner

*Primary Examiner*—Teresa Walberg
*Assistant Examiner*—Fadi H. Dahbour
(74) *Attorney, Agent, or Firm*—Sughrue, Mion, Zinn, Macpeak & Seas, PLLC

(57) ABSTRACT

In a VVA apparatus for an internal combustion engine wherein the position of contact of a cam face of a VO cam with respect to the top face of a valve lifter is changed in accordance with a change in a rocking fulcrum of a rocker arm to alter the valve lift, the maximum valve lift is obtained in a first rotated position of a control shaft where an axis of a control cam is adjacent to a driving shaft. The minimum valve lift is obtained in a second rotated position of the control shaft where the axis of the control cam is positioned near a first pivotal point of the rocker arm and a crank arm with respect to a first line connecting the axis of the control shaft and the axis of the control cam upon the maximum valve lift.

13 Claims, 24 Drawing Sheets

VARIABLE-VALVE-ACTUATION APPARATUS FOR INTERNAL COMBUSTION ENGINE

BACKGROUND OF THE INVENTION

The present invention relates to a variable-valve-actuation (VVA) apparatus for an internal combustion engine, which can change, particularly, the valve lift of an intake or exhaust valve in accordance with the engine operating conditions.

One of the VVA apparatus is shown in JP-A 11-107725. This VVA apparatus, applied to intake valves, comprises a crank cam arranged on the outer periphery of a driving shaft rotated together with a crankshaft and having an axis eccentric to an axis of the driving shaft, and a valve operating (VO) cam to which torque of the crank cam is transmitted through a transmission mechanism to have a cam face coming in slide contact with the top face of a valve lifter arranged at the upper end of the intake valve for operation thereof.

The transmission mechanism includes a rocker arm disposed above the VO cam and swingably supported to a control shaft, a crank arm having an annular base engaged with the outer peripheral surface of the crank cam and an extension rotatably connected to a first arm of the rocker arm through a pin, and a link rod having a first end rotatably connected to a second arm of the rocker arm through a pin and a second end rotatably connected to an end of the VO cam through a pin.

Moreover, fixed on the outer peripheral surface of the control shaft is a control cam having an axis eccentric to an axis of the control shaft by a predetermined amount and rotatably fitted in a support hole formed substantially in the center of the rocker arm. The control cam changes a rocking fulcrum of the rocker arm in accordance with the rotated position to change the position of contact of the cam face of the valve operating cam with respect to the top face of the valve lifter, carrying out variable control of the valve lift of the intake valve.

Specifically, when the engine operating conditions are in the high-rotation and high-load range, in order to urge an actuator to rotate the control cam in one direction through the control shaft for rotation of the control cam in the same direction, the rocking fulcrum of the rocker arm is moved to approach the driving shaft. Then, an end or a cam nose of the VO cam is pushed downward by the link rod, etc. to move the position of contact of the cam face of the VO cam with respect to the top face of the valve lifter to a lift section of the cam face. Thus, the intake valve is controlled to have the maximum valve-lift characteristic.

On the other hand, when the engine operating conditions are in the low-rotation and low-load range, the actuator rotates the control shaft in another direction for rotation of the control cam in the same direction, moving the rocking fulcrum of the rocker arm to separate from the driving shaft. Then, the pivotal point of the rocker arm and the link rod is moved upward to draw up the cam nose of the VO cam, moving the position of contact of the cam face of the VO cam with respect to the top face of the valve lifter to separate from the lift section of the cam face. Thus, the intake valve is controlled to have the minimum valve-lift characteristic.

Therefore, the VVA apparatus allows full achievement of the engine performance in accordance with the engine operating conditions, i.e., an improvement in fuel efficiency and in engine output.

With the above VVA apparatus, however, though the valve-lift characteristic can be changed by changing the rocking fulcrum of the rocker arm in accordance with the rotated position of the control cam, a full consideration is not made with regard to the direction of rotation of the control cam, particularly, the direction of rotation from the maximum valve-lift control position to the minimum valve-lift control position, and the position of rotation for minimum valve-lift control. This may raise a problem that a full reduction is impossible in the minimum valve lift due to the direction of rotation of the control cam. Moreover, this may raise another problem that during minimum valve-lift control, the line connecting the axes of first and second end pins of the link rod and the line connecting the axis of the second end pin and the axis of the driving shaft form a straight line to produce locking of the link rod, disturbing smooth rotation of the link rod and the VO cam upon transition of operation of the intake valve from closing to opening.

It is, therefore, an object of the present invention to provide a VVA apparatus for an internal combustion engine, which contributes to an improvement in the engine performance and a smooth operation of the apparatus components.

SUMMARY OF THE INVENTION

One aspect of the present invention lies in providing a variable-valve-actuation apparatus for an internal combustion engine with a cylinder head, a crankshaft and a valve, comprising:

a driving shaft rotated in synchronism with the crankshaft, said driving shaft including a crank cam on an outer periphery;

a control shaft arranged substantially parallel to said driving shaft;

a valve lifter movably arranged with respect to the cylinder head, said valve lifter including a top face;

a valve operating (VO) cam swingably supported by said driving shaft, said VO cam opening and closing the valve through said valve lifter, said VO cam including a cam face;

a crank arm including a base and an extension, said base being slidably engaged with an outer periphery of said crank cam;

a rocker arm including first and second arms, said first arm being rotatably connected to said extension of said crank arm, which forms a first pivotal point;

a link rod having a first end rotatably connected to an end of said VO cam, which forms a second pivotal point, and a second end rotatably connected to said second arm of said rocker arm, which forms a third pivotal point; and a control cam mounted to said control shaft on an outer periphery, said control cam having an axis eccentric to an axis of said control shaft, said control cam changing a rocking fulcrum of said rocker arm in accordance with a rotated position of said control shaft, whereby a position of contact of said cam face of said VO cam with respect to said top face of said valve lifter is changed in accordance with a change in said rocking fulcrum of said rocker arm to alter a lift of the valve, wherein a maximum lift of the valve is obtained in a first rotated position of said control shaft where said axis of said control cam is adjacent to said driving shaft, wherein a minimum lift of the valve is obtained in a second rotated position of said control shaft where said axis of said control cam is positioned near said first pivotal point of said rocker arm and said crank arm with respect to a first line connecting said axis of said control shaft and said axis of said control cam upon said maximum lift.

Another aspect of the present invention lies in providing a variable-valve-actuation apparatus for an internal combustion engine with a cylinder head, a crankshaft and a valve, comprising:

a driving shaft rotated in synchronism with the crankshaft, said driving shaft including a crank cam on an outer periphery;

a valve lifter movably arranged with respect to the cylinder head, said valve lifter including a top face;

a valve operating (VO) cam swingably supported by said driving shaft, said VO cam opening and closing the valve through said valve lifter, said VO cam including a cam face;

a rocker arm including first and second arms, said first arm being mechanically connected to said crank cam;

a link rod having a first end rotatably connected to an end of said VO cam, which forms a first pivotal point, and a second end rotatably connected to said second arm of said rocker arm, which forms a second pivotal point;

an alteration mechanism altering a rocking fulcrum of said rocker arm in accordance with operating conditions of the engine; and a restriction mechanism restricting an angle formed by a first line connecting an axis of said driving shaft during lift control of the valve and said first pivotal point of said link rod and said VO cam and a second line connecting said first pivotal point and said second pivotal point of said rocker arm and said link rod to less than a first predetermined angle, whereby a position of contact of said cam face of said VO cam with respect to said top face of said valve lifter is changed in accordance with a change in said rocking fulcrum of said rocker arm to alter a lift of the valve.

Still another aspect of the present invention lies in providing a variable-valve-actuation apparatus for an internal combustion engine with a cylinder head, a crankshaft and a valve, comprising:

a driving shaft rotated in synchronism with the crankshaft, said driving shaft including a crank cam on an outer periphery;

a valve lifter movably arranged with respect to the cylinder head, said valve lifter including a top face;

a transmission mechanism having one end slidably connected to said crank cam and another end; and a valve operating (VO) cam swingably supported by said driving shaft, said VO cam having an end rotatably connected to said another end of said transmission mechanism, which forms a pivotal point, said VO cam opening and closing the valve through said valve lifter, wherein the direction of a reaction force of a valve spring acting on a point of contact between said valve lifter and said VO cam during one rotation of said crank cam is changed between a first position near said driving shaft with respect to said pivotal point and a second position opposite to said driving shaft with respect to said second pivotal point.

A further aspect of the present invention lies in providing a variable-valve-actuation apparatus for an internal combustion engine with a cylinder head, a crankshaft and a valve, comprising:

a driving shaft rotated in synchronism with the crankshaft, said driving shaft including a crank cam on an outer periphery;

a support shaft arranged parallel to said driving shaft;

a valve lifter movably arranged with respect to the cylinder head, said valve lifter including a top face;

a transmission mechanism having one end slidably connected to said crank cam and another end; and a valve operating (VO) cam swingably supported by said support shaft, said VO cam having an end rotatably connected to said another end of said transmission mechanism, which forms a pivotal point, said VO cam opening and closing the valve through said valve lifter, wherein the direction of a reaction force of a valve spring acting on a point of contact between said valve lifter and said VO cam during one rotation of said crank cam is changed between a first position near said driving shaft with respect to said pivotal point and a second position opposite to said driving shaft with respect to said second pivotal point.

BRIEF DESCRIPTION OF THE DRAWINGS

FIGS. 17A–7B are views similar to FIG. 16, showing operation of the VVA apparatus when the engine is at high velocity and high load;

DETAILED DESCRIPTION OF THE INVENTION

Figure 1:
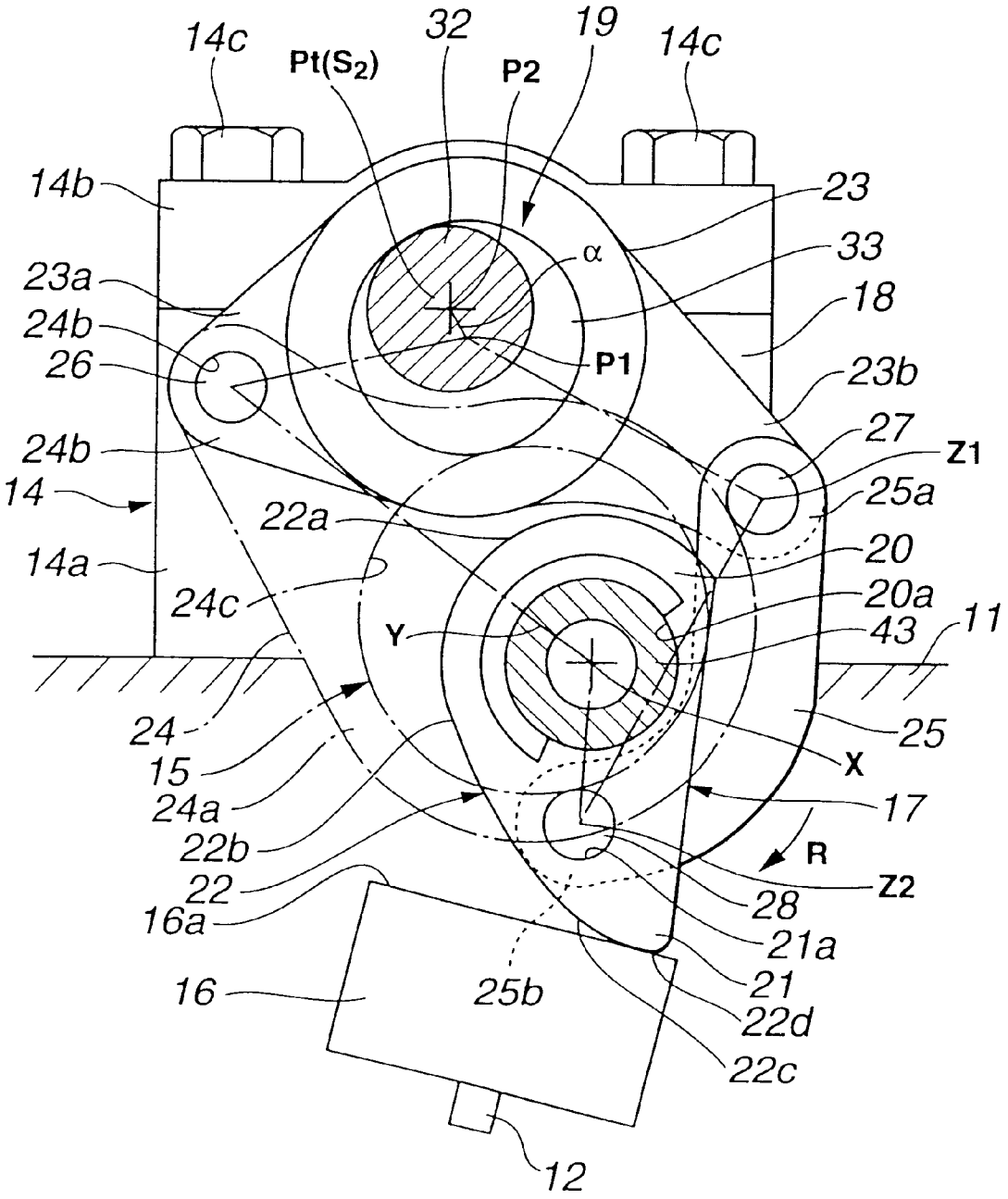
FIG. 1 shows a section taken along the line I—I in FIG. 2, showing a first embodiment of a VVA apparatus for an internal combustion engine according to the present invention.

Referring to the drawings, a description will be made with regard to a VVA apparatus for an internal combustion engine embodying the present invention. The VVA apparatus includes two intake valves per cylinder, and an alteration mechanism for altering the valve lift of the intake valves in accordance with the engine operating conditions.

Figure 2:
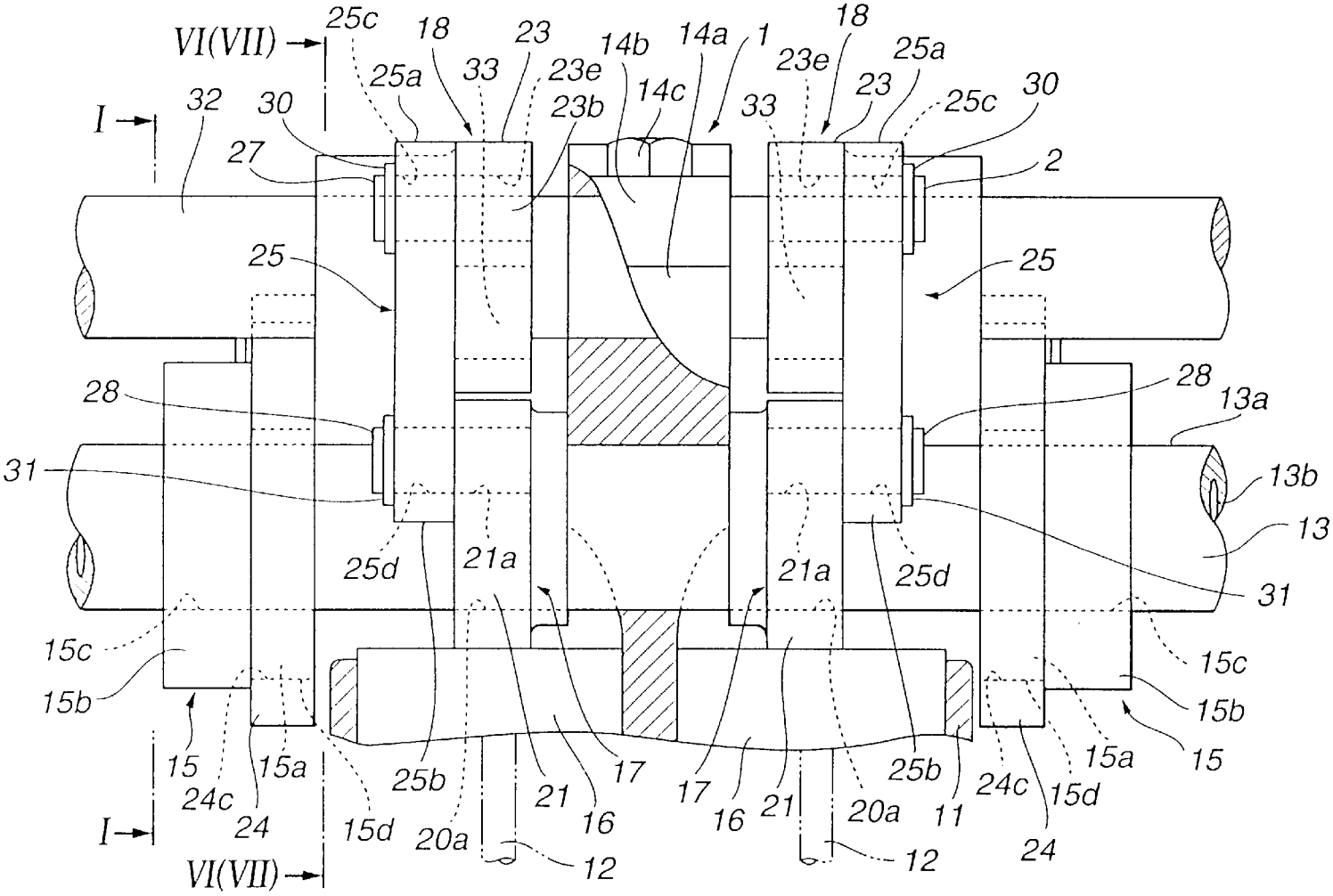
FIG. 2 is a side view, partly in section, showing the VVA apparatus.
Figure 3:
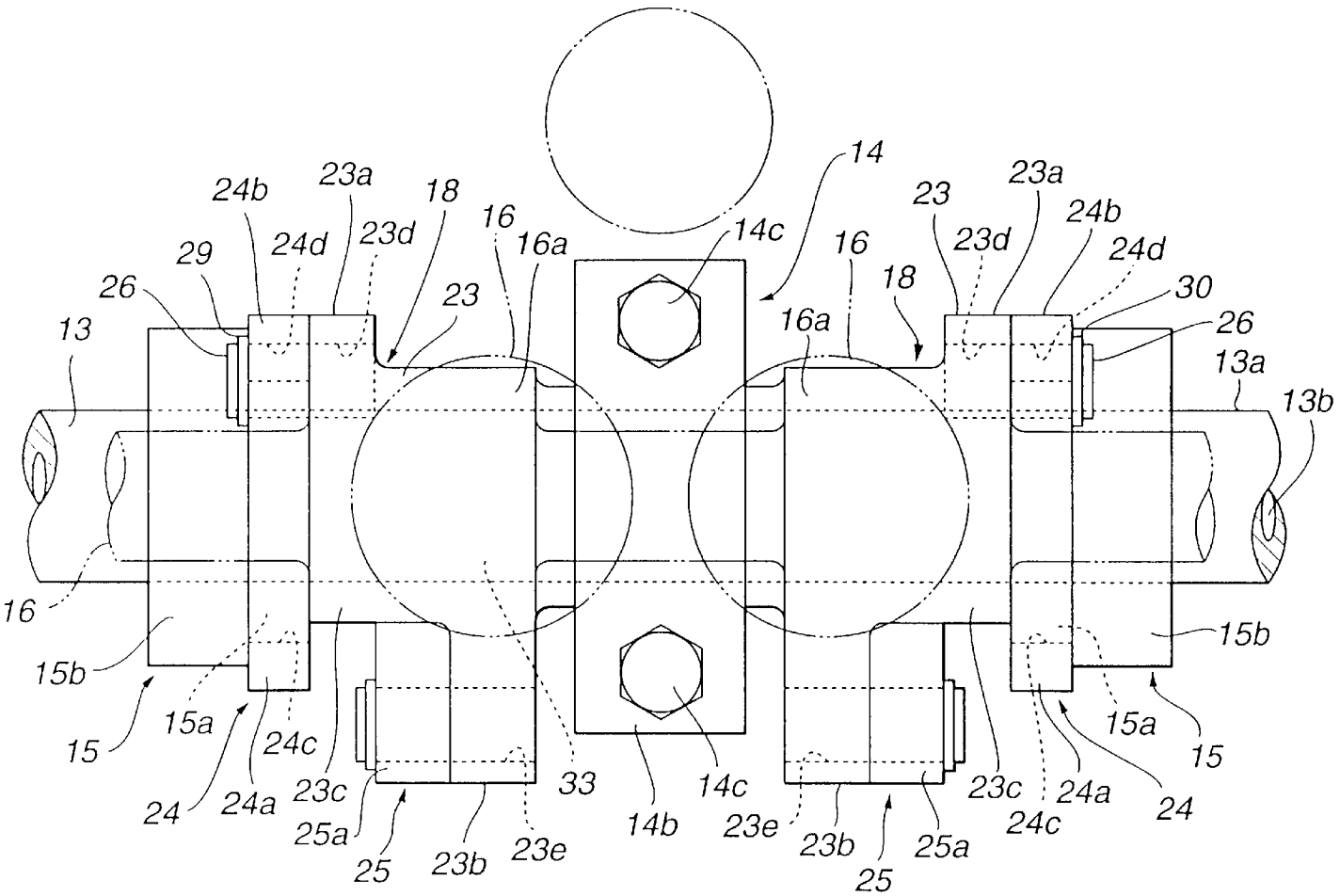
FIG. 3 is a plan view showing the VVA apparatus.

FIGS. 1–9 show a first embodiment of the present invention. Referring to FIGS. 1–3, the VVA apparatus includes a pair of intake valves 12 slidably arranged with a cylinder head 11 through valve guides, not shown, a hollow driving shaft 13 rotatably supported by a bearing 14 arranged with the cylinder head 11 in the upper portion, a pair of drive or eccentric rotating cams 15 fixed to the driving shaft 13 through press fit, etc., a pair of VO cams 17 swingably supported on an outer peripheral surface 13*a* of the driving shaft 13 and coming in slide contact with valve lifters 16 disposed at the upper ends of the intake valves 12 to open them, a transmission mechanism 18 connected between the crank cams 15 and the VO cams 17 for transmitting torque of the crank cams 15 to the VO cams 17 as a rocker force, and an alteration mechanism 19 for altering the operating position of the transmission mechanism 18.

The driving shaft 13 extends in the longitudinal direction of the engine, and has one end with a follower sprocket, a timing chain wound thereon, etc. not shown, through which torque is received from a crankshaft of the engine. The driving shaft 13 is rotated counterclockwise as viewed in FIG. 1.

The bearing 14 includes a main bracket 14*a* arranged at the upper end of the cylinder head 11 for supporting the upper portion of the driving shaft 13, and an auxiliary bracket 14*b* arranged at the upper end of the main bracket 14*a* for rotatably supporting a control shaft 32 as will be described later. The brackets 14*a*, 14*b* are fastened together from above by a pair of bolts 14*c*.

Figure 4:
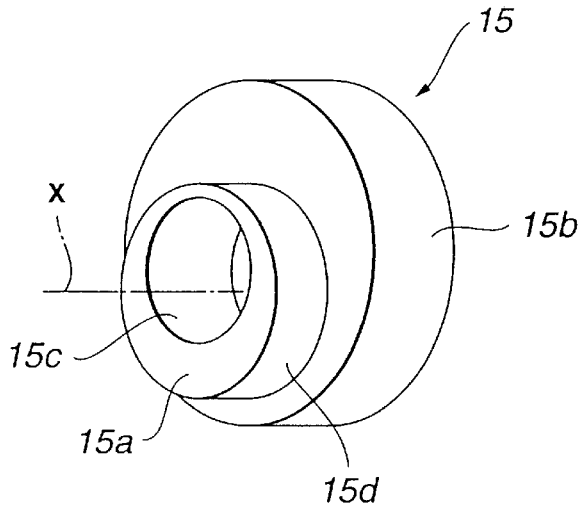
FIG. 4 is a perspective view showing a crank cam.

Referring to FIG. 4, the crank cams 15 are formed substantially like a ring, each including a small-diameter main body 15*a* and a flange 15*b* integrated with the outer end face thereof. A though hole 15*c* is formed axially to receive the driving shaft 13. An axis Y of the main body 15*a* is offset with respect to an axis X of the driving shaft 13 in the radial direction by a predetermined amount. Moreover, the crank cams 15 are press fitted to the driving shaft 13 through the through hole 15*c* on the outer sides where no interference occurs with the valve lifters 16. The main bodies 15*a* have outer peripheral surfaces 15d formed in the same profile.

The valve lifters 16 are formed like a covered cylinder, each being slidably held in a hole of the cylinder head 11 and having a flat top face 16*a* with which the VO cam 17 comes in slide contact.

Referring to FIGS. 1–3 and 6A–7B, the VO cam 17 is formed substantially like a raindrop, and has a support hole 20*a* at a substantially annular base end 20, through which the driving shaft 13 is arranged for rotatable support. The VO cam 17 also has a pin hole 21*a* on the side of a cam nose 21. The lower side of the VO cam 17 is formed with a cam face 22 including a base-circle face 22*a* on the side of the base end 20, a ramp face 22*b* circularly extending from the base-circle face 22*a* to the cam nose 21, and a lift face 22*c* extending from the ramp face 22*b* to a top face 22*d* with the maximum lift arranged at an end of the cam nose 21. The base-circle face 22*a*, the ramp face 22*b*, the lift face 22*c*, and the top face 22*d* come in contact with predetermined points of the top face 16*a* of the valve lifter 16 in accordance with the rocking position of the VO cam 17.

Figure 5:
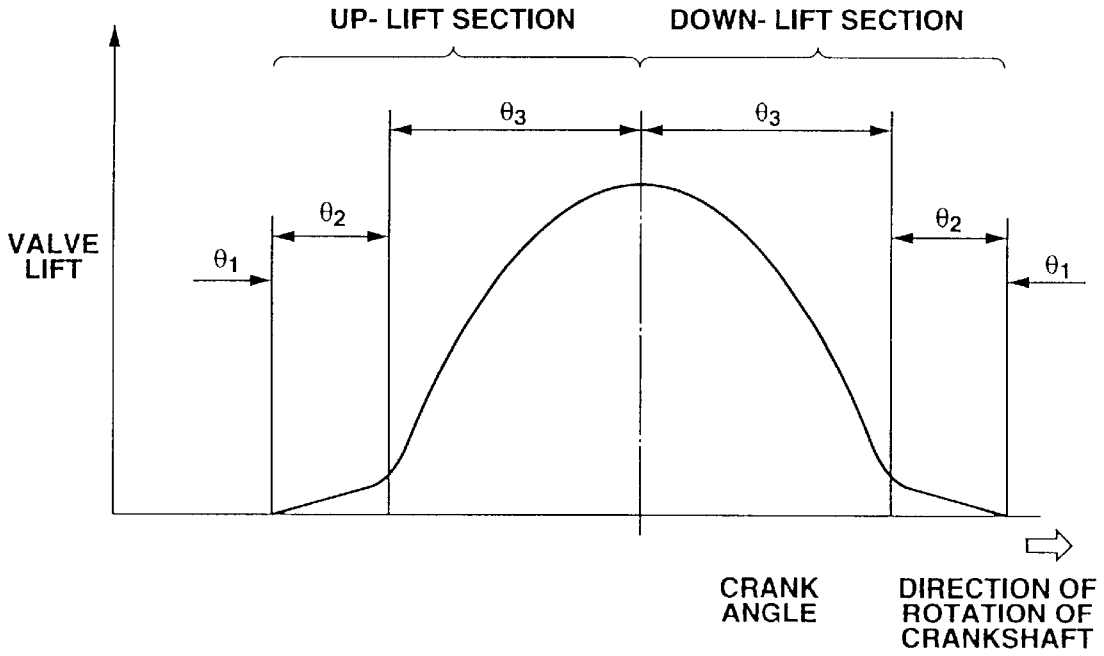
FIG. 5 is a graph illustrating a valve-lift characteristic of a VO cam.

Specifically, referring to FIG. 5, in view of the valve-lift characteristic, a predetermined angular range $\theta_1$ of the base-circle face 22*a* corresponds to a base-circle section, and a predetermined angular range $\theta_2$ of the ramp face 22*b* subsequent to the base-circle section $\theta_1$ corresponds to a ramp section, and a predetermined angular range $\theta_3$ of the ramp face 22*b* from the ramp section $\theta_2$ to the top face 22*d* corresponds to a lift section.

The transmission mechanism 18 includes a rocker arm 23 disposed above the driving shaft 13, a crank arm 24 for linking a first arm 23*a* of the rocker arm 23 with the crank cam 15, and a link rod 25 for linking a second arm 23*b* of the rocker arm 23 with the VO cam 17.

Referring to FIG. 3, the VO cam 23 is formed substantially like a crank as viewed in a plan, and has in the center a cylindrical base 23*c* rotatably supported by a control cam 33 as will be described later. The first arm 23*a* protruding from an outer end of the cylindrical base 23*c* has a pin hole 23*d* for receiving a pin 26, whereas the second arm 23*b* protruding from an inner end of the cylindrical base 23*c* has a pin hole 23*e* for receiving a pin 27 for connecting the second arm 23*b* and a first end 25*a* of the link rod 25.

The crank arm 24 includes a relatively-large-diameter annular base 24*a* and an extension 24*b* arranged in a predetermined position of the outer peripheral surface of the base 24*a*. The base 24*a* has in the center an engagement hole 24*c* rotatably engaged with the outer peripheral surface of the main body 15*a* of the crank cam 15. The extension 24*b* has a pin hole 24*d* for rotatably receiving the pin 26.

As best seen in FIG. 1, the link rod 25 is formed substantially like a letter L having a concave on the side of the rocker arm 23, and has first and second ends 25*a*, 25*b* formed with pin holes 25*c*, 25*d* through which ends of the pins 27, 28 press fitted in the pin holes 23*e*, 21*a* of the second arm 23*b* of the rocker arm 23 and the cam nose 21 of the VO cam 17 are rotatably arranged. An axis Z2 of the pin 28 forms a rocking fulcrum of the VO cam 17.

Arranged at one ends of the pins 26, 27, 28 are snap rings 29, 30, 31 for restricting axial movement of the crank arm 24 and the link rod 25.

The alteration mechanism 19 includes the control shaft 32 rotatably supported by the bearing 14 above the driving shaft 13 and the control cam 33 fixed on the outer periphery of the control shaft 32 for forming a rocking fulcrum of the rocker arm 23.

The control shaft 32 is disposed parallel to the driving shaft 13 and in the longitudinal direction of the engine to be rotatable within a predetermined range of angle of rotation by an electromagnetic actuator, not shown, arranged at one end.

The control cam 33 is formed like a cylinder, and has an axis P1 eccentric to an axis P2 of the control shaft 32 by an amount $\alpha$ corresponding to a thick portion 33*a* as shown in FIG. 1.

Figure 6B:
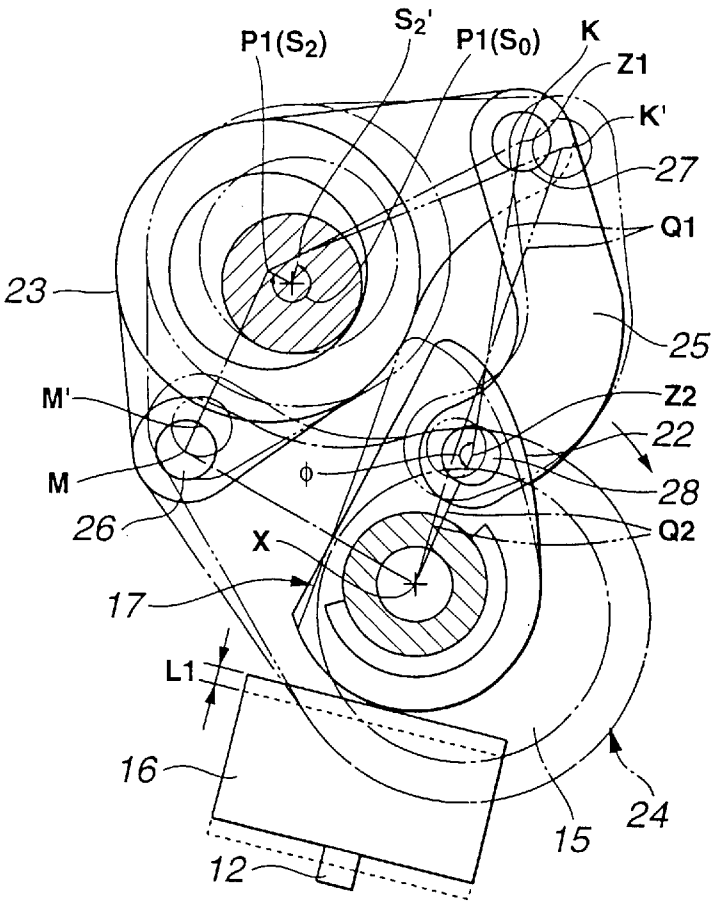
FIGS. 6A–6B are views similar to FIG. 1, taken along the line VI—VI in FIG. 2, showing operation of the VVA apparatus when the engine is at low velocity and low load.
Figure 6A:
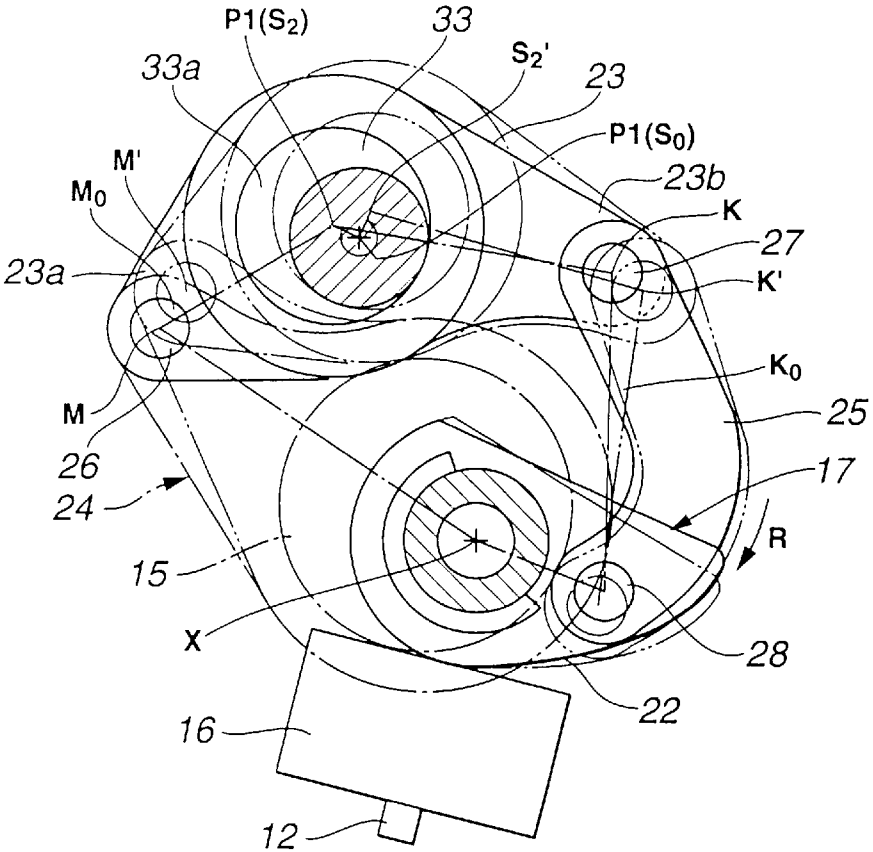
Figure 7B:
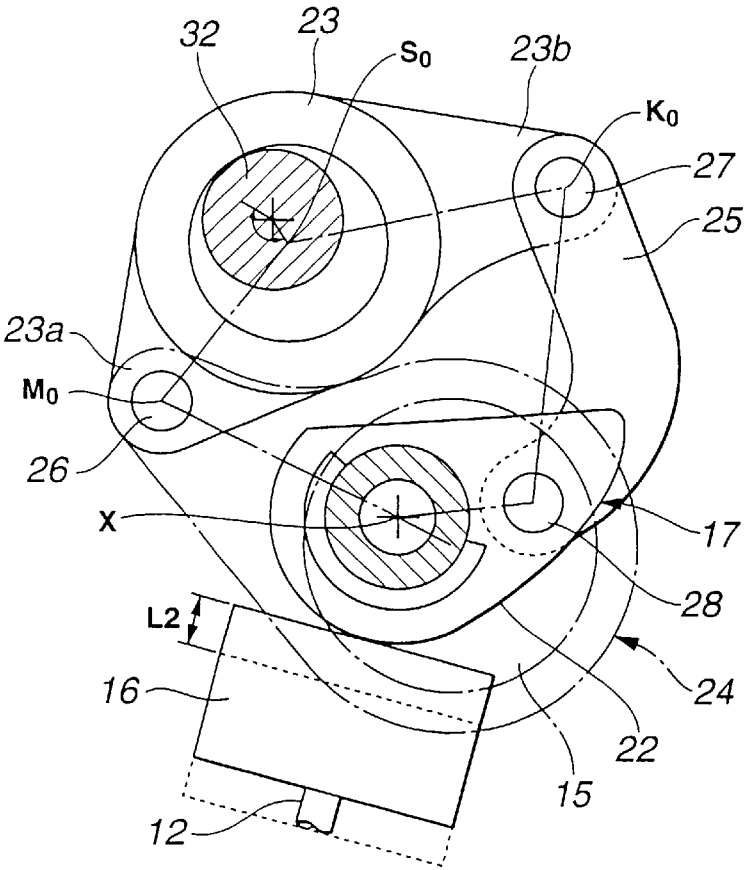
FIGS. 7A–7B are views similar to FIGS. 6A–6B, taken along the line VII—VII in FIG. 2, showing operation of the VVA apparatus when the engine is at high velocity and high load.
Figure 7A:
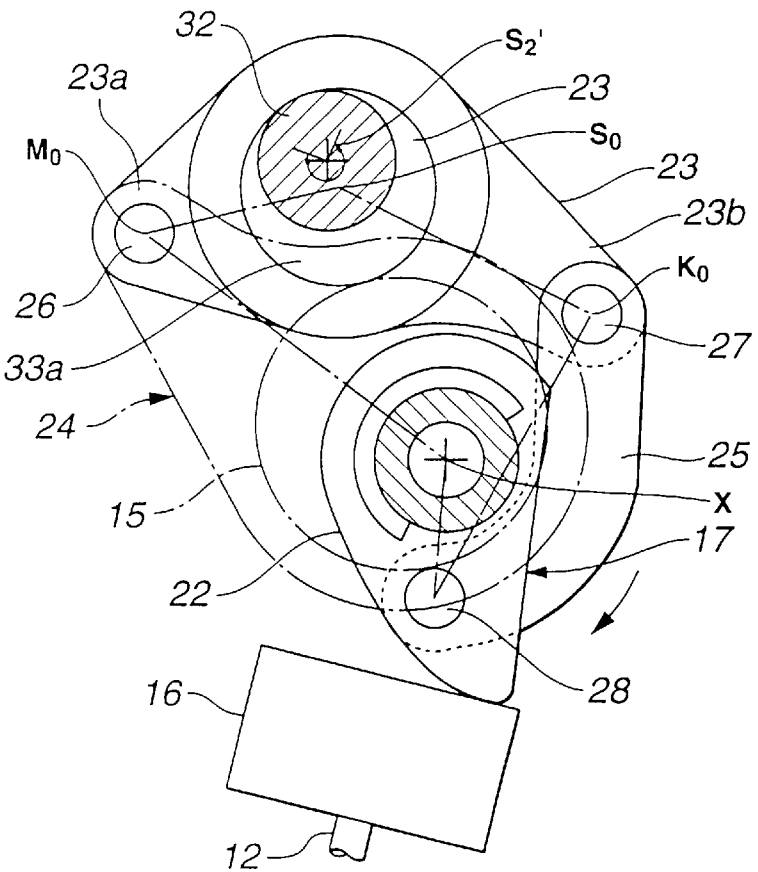

Referring to FIGS. 6A and 7A, the range of angle of rotation of the control shaft 32 will be described. In terms of the axis P1 of the control cam 33, a first rotation-angle position So where the thick portion 33*a* of the control cam 33 approaches the axis X of the driving shaft 13 corresponds to the maximum valve-lift control position of the intake valve 12 due to connection of the transmission mechanism 18 and the VO cam 17. The axis P1 is rotatable clockwise as viewed in FIG. 1, i.e., from the first rotation-angle position So to a second rotation-angle position S2 located at about 150° on the side of the pin 26 for connecting the rocker arm 18 and the crank arm 24. The second rotation-angle position $S_2$ corresponds to the minimum valve-lift control position of the intake valve 12. The control cam 33 is rotatable counterclockwise as viewed in FIG. 1 from the second rotation-angle position $S_2$ to the first rotation-angle position So by the control shaft 32, but in the same direction as the direction (arrow R) of opening of the intake valve 12 by the VO cam 17 from the first rotation-angle position So to the second rotation-angle position $S_2$ as shown in FIG. 6A.

The actuator for rotating the control shaft 32 within the range between the first and second rotation-angle positions So, $S_2$ is driven in accordance with a control signal out of a controller, not shown, for determining the engine operating conditions. The controller determines the actual engine operating conditions in accordance with detection signals out of various sensors such as a crank angle sensor, an air flow meter and a coolant temperature sensor to output a control signal to the actuator.

Next, operation of the first embodiment will be described. When the engine is at low velocity and at low load, the control shaft 32 is rotated clockwise by the actuator in accordance with a control signal out of the controller. This moves the thick portion 33*a* of the control cam 33 upward with respect to the driving shaft 13, so that the axis P1 of the control cam 33 is kept in the second rotation-angle position $S_2$ located in the top left direction of the axis P2 of the control shaft 32 as shown by the full lines in FIGS. 6A–6B. Thus, the pivotal point of the second arm 23*b* of the rocker arm 23 and the link rod 25 is moved upward with respect to the driving shaft 13, so that the VO cam 17, having the cam nose 21 forcibly drawn up through the link rod 25, is rotated counterclockwise in its entirety. With the VO cam 17, referring to FIG. 6A, the full line shows the maximally rocked position or the peak valve-lift position, whereas referring to FIG. 6B, the full line shows the excessively rotated or maximally jumping position or the non-valve-lift position.

Referring to FIGS. 6A–6B, when rotation of the crank cam 15 pushes the first arm 23*a* of the rocker arm 23 upward through the crank arm 24, a valve lift L1, which is fully small as shown in FIG. 6B, is transmitted to the VO cam 17 and the valve lifter 16 through the link rod 25.

Figure 8:
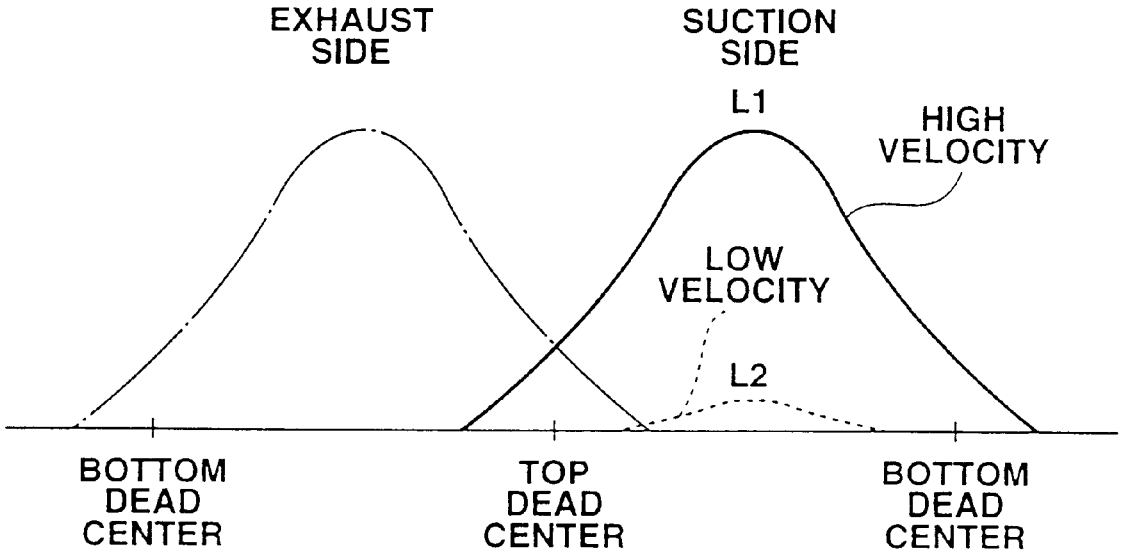
FIG. 8 is a view similar to FIG. 5, illustrating the relation between valve timing and valve lift.

Thus, in such low-velocity and low-load range, referring to FIG. 8, the intake valve 12 has smaller valve lift and delayed opening timing as shown by the broken line, resulting in small valve overlap with the exhaust valve. This allows improved fuel efficiency and stable engine rotation.

On the other hand, when the engine is at high velocity and high load, the control shaft 32 is rotated counterclockwise by the actuator in accordance with a control signal out of the controller. Thus, referring to FIGS. 7A–7B, the control shaft 32 rotates the control cam 33 counterclockwise from the position as shown by the full line in FIGS. 6A–6B to the first rotation-angle position So, moving the axis P1 (thick portion 33*a*) downward. This moves the rocker arm 23 in the direction of the driving shaft 13 or downward in its entirety, which urges the second arm 23*b* to push the cam nose 21 of the VO cam 17 downward through the link rod 25, rotating clockwise the VO cam 17 in its entirety by a predetermined amount.

Therefore, the position of contact of the cam face 22 of the VO cam 17 with respect to the top face 16*a* of the valve lifter 16 is moved to the right or on the side of the top face 22*d* as shown in FIGS. 7A–7B. Thus, the crank cam 15 is rotated as shown in FIG. 7A to push the first arm 23*a* of the rocker arm 23 upward through the crank arm 24, obtaining a large valve lift L2 with respect to the valve lifter 16 as shown in FIG. 7B.

In such high-velocity and high-load range, the cam-lift characteristic is larger as compared with the low-velocity and low-load range, obtaining larger valve lift and advanced opening timing and delayed closing timing of the intake valve 12 as shown by the full line in FIG. 8. This results in an improvement in intake-gas filling efficiency, ensuring full engine output.

When passing from the high-velocity and high-load range with maximum valve-lift control to the low-velocity and low-load range, the control cam 33 is rotated, as described above, from the first rotation-angle position So to the second rotation-angle position $S_2$ as shown in FIGS. 6A–6B. Control of the direction of rotation and the rotation-angle position of the control cam 33 allows a full reduction in the valve lift and a prevention of locking of the link rod 25.

Referring to FIGS. 6A–6B, a consideration will be made with regard to the direction of rotation of the control cam 33. Control from the maximum valve-lift control position or the first rotation-angle position So to the minimum valve-lift position can be achieved by rotating the control cam 33 clockwise as shown by the full lines, which is the way of the first embodiment, or by rotating the control am 33 counterclockwise at the same angle of rotation as shown by the one-dot chain lines. When having counterclockwise rotation, the axis P1 of the control cam 33 is moved to $S_{2'}$ as shown by the one-dot chain line in FIG. 6A, so that the pivotal point Mo of the rocker arm 23 and the crank arm 24 upon the maximum valve lift is moved to M' located in the top right direction of Mo, moving the rocking center of the rocker arm 23 upward. This moves a pivotal point Ko of the rocker arm 23 and the link rod 25 upon the maximum valve lift to K' located in the top right direction of Ko. Thus, the VO cam 17, having the cam nose 21 drawn up with movement of the link rod 25 to the upper position K', has the position of contact moved to the side going away from the top face 22*d*, obtaining the minimum valve lift. In that case, however, due to clockwise rotation of the rocker arm 23 in its entirety, the point K' is not fully high, so that the minimum valve lift cannot be made to fully approach zero.

On the other hand, in the first embodiment, the control cam 33 is rotated clockwise, so that when the axis P1 of the control cam 33 is moved to the second rotation-angle position S2 as shown in FIG. 6A, the pivotal point Mo is moved to M below and at the left of Mo, moving counterclockwise the rocker arm 23 in its entirety as shown by the full line in FIG. 6A. Thus, the pivotal point K is moved further in the top left direction of K', so that the VO cam 17, having the cam nose 21 relatively largely drawn up with movement of the link rod 25, has a portion close to the base 22*a* coming in contact with the top face 16*a* of the valve lifter 16. Therefore, the minimum valve lift can be made to fully approach zero.

Figure 9:
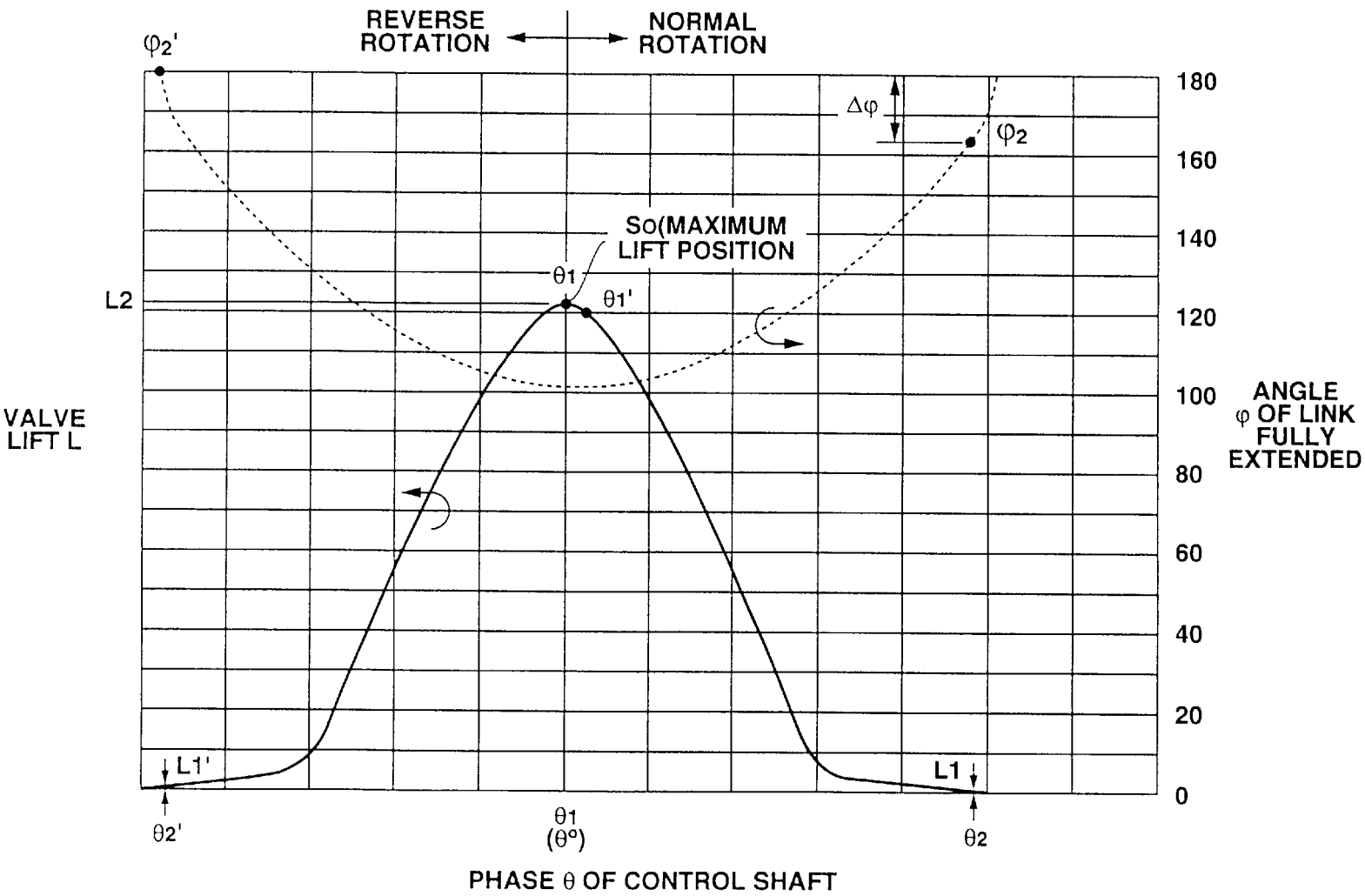
FIG. 9 is a view similar to FIG. 8, illustrating the correlation between rotation phase and valve lift when rotating a control shaft in the normal direction and in the reverse direction.

FIG. 9 shows the correlation between a rotation phase angle θ and a valve lift L when rotating the control cam 33, i.e., the control shaft 32, clockwise or in the normal direction or counterclockwise or in the reverse direction. Suppose that the control shaft 32 is rotated from the maximum valve-lift control position So in the normal direction and in the reverse direction by the same amount d2. As described above, due to the positional relationship between the pivotal points K, K' of the rocker arm 23 and the link rod 25, in the minimum valve-lift control position $\theta_2'$ on the reverse-rotation side, the valve lift L1' cannot be made to fully approach zero. On the other hand, in the minimum valve-lift control position $\theta_2$ on the normal-rotation side, the valve lift L1 can be made to fully approach zero. This allows an improvement in the valve-lift characteristic of the intake valve 12, resulting in improved engine performance.

Moreover, when rotating the control shaft 32 in the normal direction, the pivotal point K of the rocker arm 23 and the link rod 25 is moved further to the left with respect to the pivotal point K' when rotating the control shaft 32 in the reverse direction. Thus, as shown by the full line in FIG. 6B, a line Q1 connecting the axes Z1, Z2 of the pins 27, 28 of the first and second ends 25*a*, 25*b* of the link rod 25 and a line Q2 connecting the axis Z2 of the pin 28 of the second end 25*b* and the axis X of the driving shaft 13 do not form a straight line, but an L-shaped line. Specifically, when rotating the control shaft 32 in the reverse direction to obtain the minimum valve lift, the pivotal point K' is not fully moved to the left as described above, the two lines Q1, Q2 form a substantially straight line, having possible locked state where the link rod 25 is fully extended. In the first embodiment, however, the two lines Q1, Q2 form an L-shaped line, which allows smooth rotation of the link rod 25 and the VO cam 17 upon transition of operation of the intake valve 12 from closing to opening, having no disturbance of smooth operation of the intake valve 12.

Referring to FIG. 9, a complementary description will be made with regard to an angle ϕ formed by the lines Q1, Q2. Suppose that the control shaft 32 is rotated by d2 from the maximum valve-lift position $\theta_1$. Upon normal rotation, the angle $\phi_2$ is about 160°, which allows the L-shape with fully small minimum valve lift L1. Upon reverse rotation, the angle $\phi_2'$ is about 180°, having full extension and relatively large minimum lift L1'.

Figure 10:
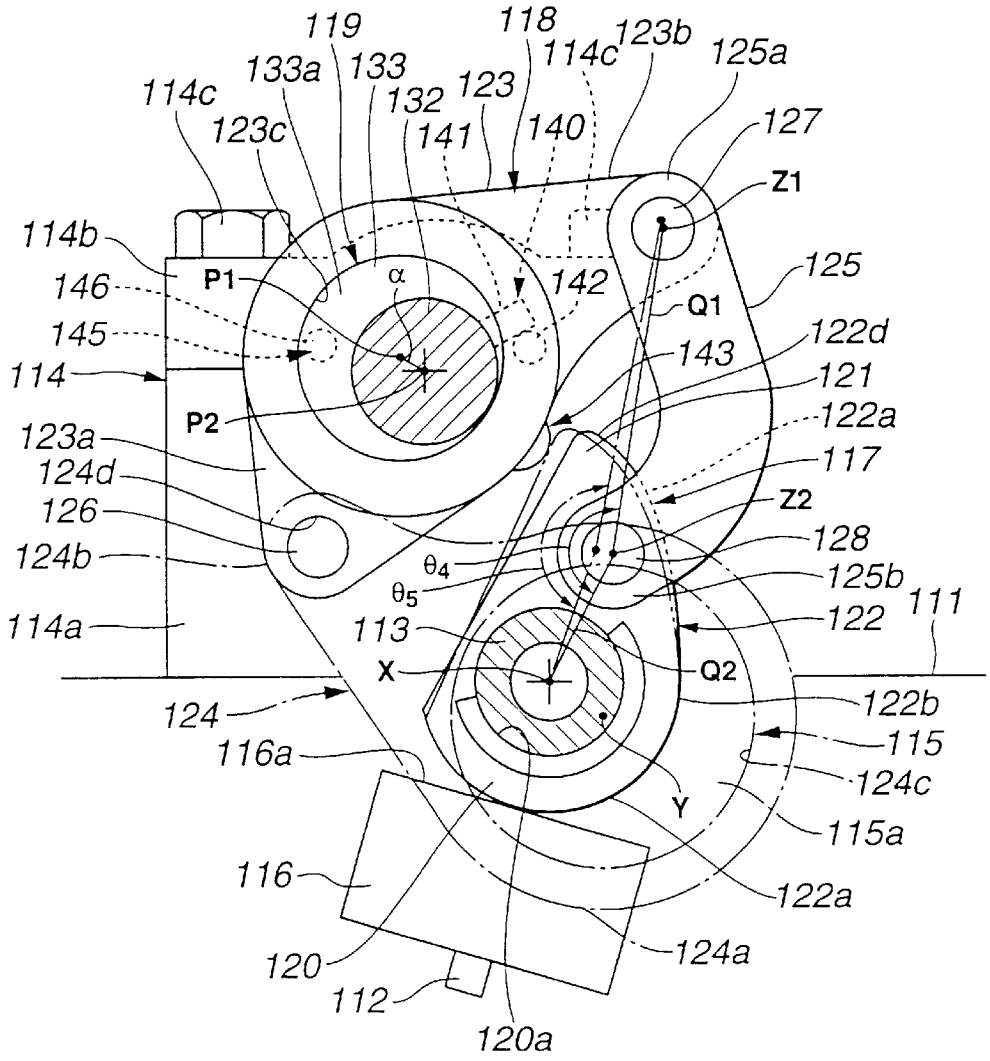
FIG. 10 is a view similar to FIGS. 7A–7B showing a second embodiment of the present invention.
Figure 11:
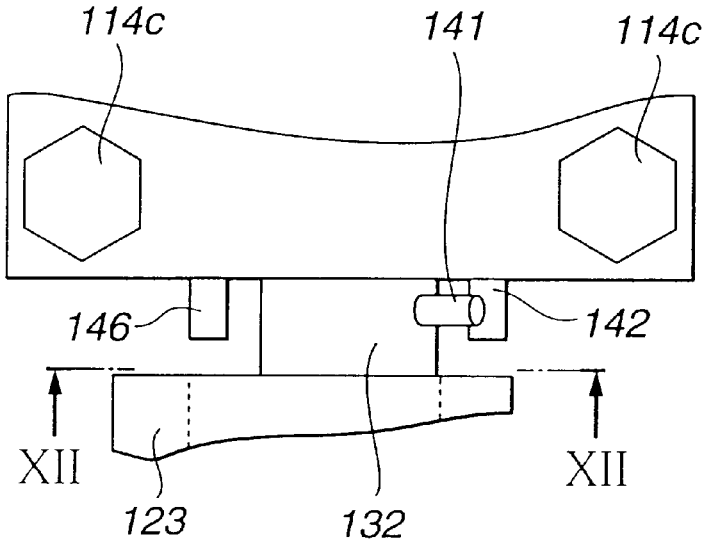
FIG. 11 is a fragmentary plan view showing the VVA apparatus in FIG. 10.
Figure 12:
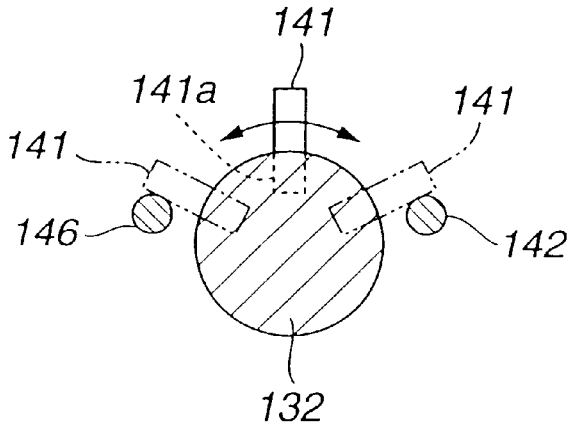
FIG. 12 is a view similar to FIG. 10, taken along the line XII—XII in FIG. 11.
Figure 13:
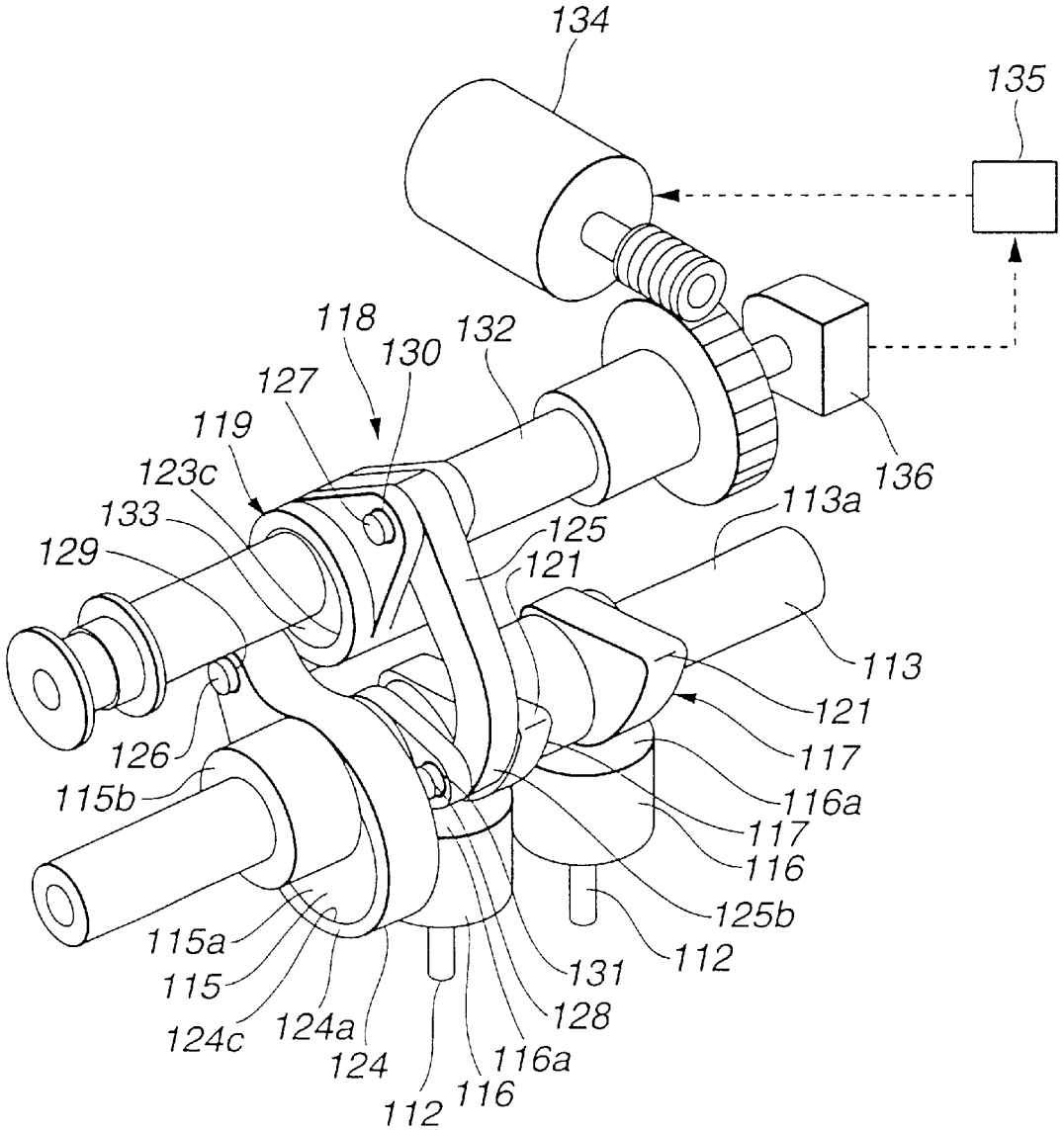
FIG. 13 is a view similar to FIG. 4, showing the VVA apparatus in FIG. 10.

FIGS. 10–19 show a second embodiment of the present invention. Referring to FIGS. 10 and 13, the VVA apparatus includes a pair of intake valves 112 slidably arranged with a cylinder head 111 through valve guides, not shown, a hollow driving shaft 113 rotatably supported by a bearing 114 arranged with the cylinder head 111 in the upper portion, a crank cam 115 fixed to the driving shaft 113 through press fit, etc., a pair of VO cams 117 swingably supported on an outer peripheral surface 113*a* of the driving shaft 113 and coming in slide contact with valve lifters 116 disposed at the upper ends of the intake valves 112 to open them, a transmission mechanism 118 connected between the crank cam 115 and the VO cams 117 for transmitting torque of the crank cam 115 to the VO cams 117 as a rocker force, and an alteration mechanism 119 for altering the operating position of the transmission mechanism 118.

The driving shaft 113 extends in the longitudinal direction of the engine, and has one end with a follower sprocket, a timing chain wound thereon, etc. not shown, through which torque is received from a crankshaft of the engine. The driving shaft 113 is rotated counterclockwise as viewed in FIG. 10.

The bearing 114 includes a main bracket 114*a* arranged at the upper end of the cylinder head 111 for supporting the upper portion of the driving shaft 113, and an auxiliary bracket 114*b* arranged at the upper end of the main bracket 114*a* for rotatably supporting a control shaft 132 as will be described later. The brackets 114*a*, 114*b* are fastened together from above by a pair of bolts 114*c*.

Figure 14:
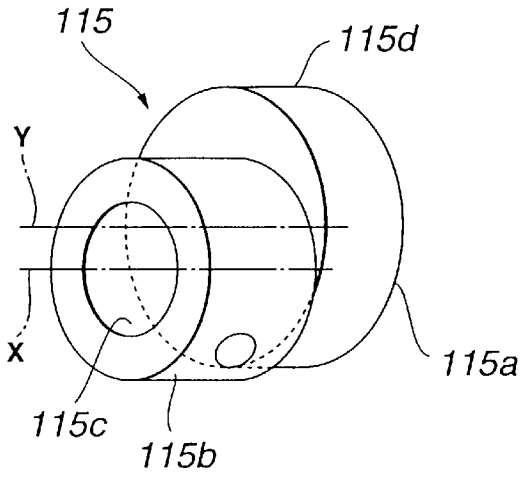
FIG. 14 is a view similar to FIG. 13, showing a crank cam used in the second embodiment.

Referring to FIG. 14, the crank cam 115 includes a substantially annular main body 115*a* and a cylindrical portion 115*b* integrated with the outer end face thereof. A though hole 115*c* is formed axially to receive the driving shaft 113. An axis Y of the main body 115*a* is offset with respect to an axis X of the driving shaft 113 in the radial direction by a predetermined amount. Moreover, the crank cam 115 is press fitted to the driving shaft 113 through the through hole 115*c* on the outer side where no interference occurs with the valve lifters 116. The main body 115*a* has an outer peripheral surface 115*d* formed in the same profile.

The valve lifters 116 are formed like a covered cylinder, each being slidably held in a hole of the cylinder head 111 and having a flat top face 116*a* with which the VO cam 117 comes in slide contact.

Referring to FIGS. 10 and 13, the VO cam 117 is formed substantially like a raindrop, and has a support hole 120*a* at a substantially annular base end 120, through which the driving shaft 113 is arranged for rotatable support. The VO cam 117 also has a pin hole 121*a* on the side of a cam nose 121. The lower side of the VO cam 117 is formed with a cam face 122 including a base-circle face 122*a* on the side of the base end 120, a ramp face 122*b* circularly extending from the base-circle face 122*a* to the cam nose 121, and a lift face 122*c* extending from the ramp face 122*b* to a top face 122*d* with the maximum lift arranged at an end of the cam nose 121. The base-circle face 122*a*, the ramp face 122*b*, the lift face 122*c*, and the top face 122*d* come in contact with predetermined points of the top face 116*a* of the valve lifter 116 in accordance with the rocking position of the VO cam 117.

Figure 15:
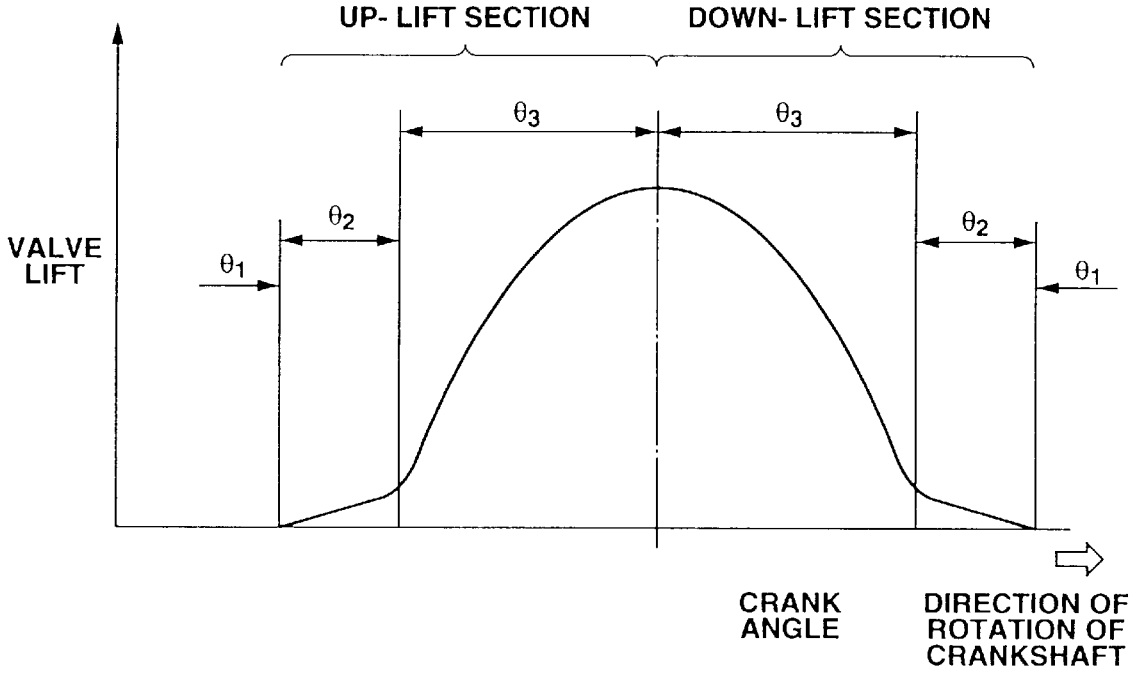
FIG. 15 is a view similar to FIG. 9, illustrating the relation between valve timing and valve lift.

Specifically, referring to FIG. 15, in view of the valve-lift characteristic, a predetermined angular range $\theta_1$ of the base-circle face 122*a* corresponds to a base-circle section, and a predetermined angular range $\theta_2$ of the ramp face 122*b* subsequent to the base-circle section $\theta_1$ corresponds to a ramp section, and a predetermined angular range $\theta_3$ of the ramp face 122*b* from the ramp section $\theta_2$ to the top face 122*d* corresponds to a lift section.

The transmission mechanism 118 includes a rocker arm 123 disposed above the driving shaft 113, a crank arm 124 for linking a first arm 123*a* of the rocker arm 123 with the crank cam 115, and a link rod 125 for linking a second arm 123*b* of the rocker arm 123 with the VO cam 117.

Referring to FIGS. 10 and 13, the VO cam 123 has in the center a cylindrical base swingably supported by a control cam 133 as will be described later through a support hole

123*c*. The first arm 123*a* protruding from an outer end of the cylindrical base has a pin hole for receiving a pin 126, whereas the second arm 123*b* protruding from an inner end of the cylindrical base has a pin hole for receiving a pin 127 for connecting a first end 125*a* of the link rod 125.

The crank arm 124 includes a relatively-large-diameter annular base 124*a* and an extension 124*b* arranged in a predetermined position of the outer peripheral surface of the base 124*a*. The base 124*a* has in the center an engagement hole 124*c* rotatably engaged with the outer peripheral surface of the main body 115*a* of the crank cam 115. The extension 124*b* has a pin hole 124*d* for rotatably receiving the pin 126.

As best seen in FIG. 10, the link rod 125 is formed substantially like a letter L having a concave on the side of the rocker arm 123, and has first and second ends 125*a*, 125*b* formed with pin holes through which ends of the pins 127, 128 press fitted in the pin holes of the second arm 123*b* of the rocker arm 123 and the cam nose 121 of the VO cam 117 are rotatably arranged. An axis Z2 of the pin 128 forms a rocking fulcrum of the VO cam 117.

Arranged at one ends of the pins 126, 127, 128 are snap rings 129, 130, 131 for restricting axial movement of the crank arm 124 and the link rod 125.

The alteration mechanism 119 includes the control shaft 132 rotatably supported by the bearing 114 above the driving shaft 113 and the control cam 313 fixed on the outer periphery of the control shaft 132 for forming a rocking fulcrum of the rocker arm 123.

The control shaft 132 is disposed parallel to the driving shaft 113 and in the longitudinal direction of the engine to be rotatable within a predetermined range of angle of rotation by an electromagnetic actuator or DC motor 134 arranged at one end.

The control cam 133 is formed like a cylinder, and has an axis P1 eccentric to an axis P2 of the control shaft 132 by an amount a corresponding to a thick portion 133*a* as shown in FIG. 10.

Referring to FIGS. 10–12, a first restriction mechanism 140 is arranged between the bearing 114 and the control shaft 132 to restrict excessive rotation of the control shaft 132 during minimum valve-lift control. The first restriction mechanism 140 includes a stopper pin 141 arranged with the control shaft 132 to protrude radially and a first stopper protrusion 142 arranged on one side face of the auxiliary bracket 114*b* of the bearing 114 to protrude axially with respect to the control shaft 132, with which the first stopper pin 141 comes in contact to restrict the maximally rotated position of the control shaft 132 during minimum valve-lift control.

As shown in FIG. 12, the stopper pin 141 has a base end 141*a* press fitted in a fixing hole formed radially in the control shaft 132, the circumferential position of which is determined based on the relative angular position with respect to the first stopper protrusion 142.

Specifically, as shown in FIG. 10, when the VO cam 117 jumps maximally with the intake valve 112 being subjected to minimum valve-lift control by rotation control of the control shaft 132 as will be described later, an angle formed by a line Q1 connecting the axes Z1, Z2 of the pins 127, 128 and a line Q2 connecting the axis X of the driving shaft 113 and the axis Z2 of the pin 128 is equal to an angle $\theta_4$ that allows a full prevention of locking between the VO cam 117 and the link rod 125. In the second embodiment, the angle $\theta_4$ is determined to be about 165°.

Referring to FIG. 10, a second restriction mechanism 143 is arranged on the outer surface of the cylindrical base of the rocker arm 123 on the side of the VO cam 117. The second restriction mechanism 143 includes a second stopper protrusion 144 (see FIG. 16) arranged on the outer surface of the cylindrical base of the rocker arm 123. The second stopper protrusion 144 comes in contact with the top face of the VO cam 117 on the side of the cam nose 121 to restrict further rocking motion of the rocker arm 123. The second stopper protrusion 144 is formed like a sphere, and has an amount of protrusion determined such that when coming in contact with the VO cam 117 as shown by the two-dot chain line in FIG. 10, an angle formed by the lines Q1, Q2 is equal to an angle $\theta_5$ that is slightly larger than the angle $\theta_4$, but allows a prevention of above locking.

A third restriction mechanism 145 is arranged opposite to the first restriction mechanism 140 to restrict the maximally rotated position of the control shaft 132 in the reverse direction or during maximum valve-lift control. The third restriction mechanism 145 includes a third stopper protrusion 146 for restricting the rotated position of the stopper pin 141. The third stopper protrusion 146 is arranged on one side face of the auxiliary bracket 114*b* of the bearing 114 on the side opposite to the first stopper protrusion 142 with respect to the control shaft 132 to protrude axially with respect thereto. The third stopper protrusion 146 is positioned to define an angle that allows a prevention of possible locking between the VO cam 117 and the link rod 125 in the counterclockwise maximally rotated position of the control shaft 132 as viewed in FIGS. 10 and 12 during maximum valve-lift control by excessive rotation of the control shaft 132.

Referring to FIG. 13, the actuator 134 for rotating the control shaft 132 within the range between the first and second rotation-angle positions is driven in accordance with a control signal out of a controller 135 for determining the engine operating conditions. The controller 135 determines the actual engine operating conditions in accordance with detection signals out of various sensors such as a crank angle sensor, an air flow meter, a coolant temperature sensor, and a potentiometer to output a control signal to the actuator 134.

Next, operation of the second embodiment will be described. When the engine is at low velocity and at low load, the control shaft 132 is rotated clockwise as shown in FIG. 10 by the actuator 134 in accordance with a control signal out of the controller 135 until the stopper pin 141 comes in contact with the first stopper protrusion 142. This moves the thick portion 133*a* of the control cam 133 upward with respect to the driving shaft 113, so that the axis P1 of the control cam 133 is kept in the second rotation-angle position located in the top left direction of the axis P2 of the control shaft 132 as shown by the full lines in FIGS. 6A–6B. Thus, the pivotal point of the second arm 123*b* of the rocker arm 123 and the link rod 125 is moved upward with respect to the driving shaft 113, so that the VO cam 117, having the cam nose 121 forcibly drawn up through the link rod 125, is rotated counterclockwise in its entirety.

Figure 16:
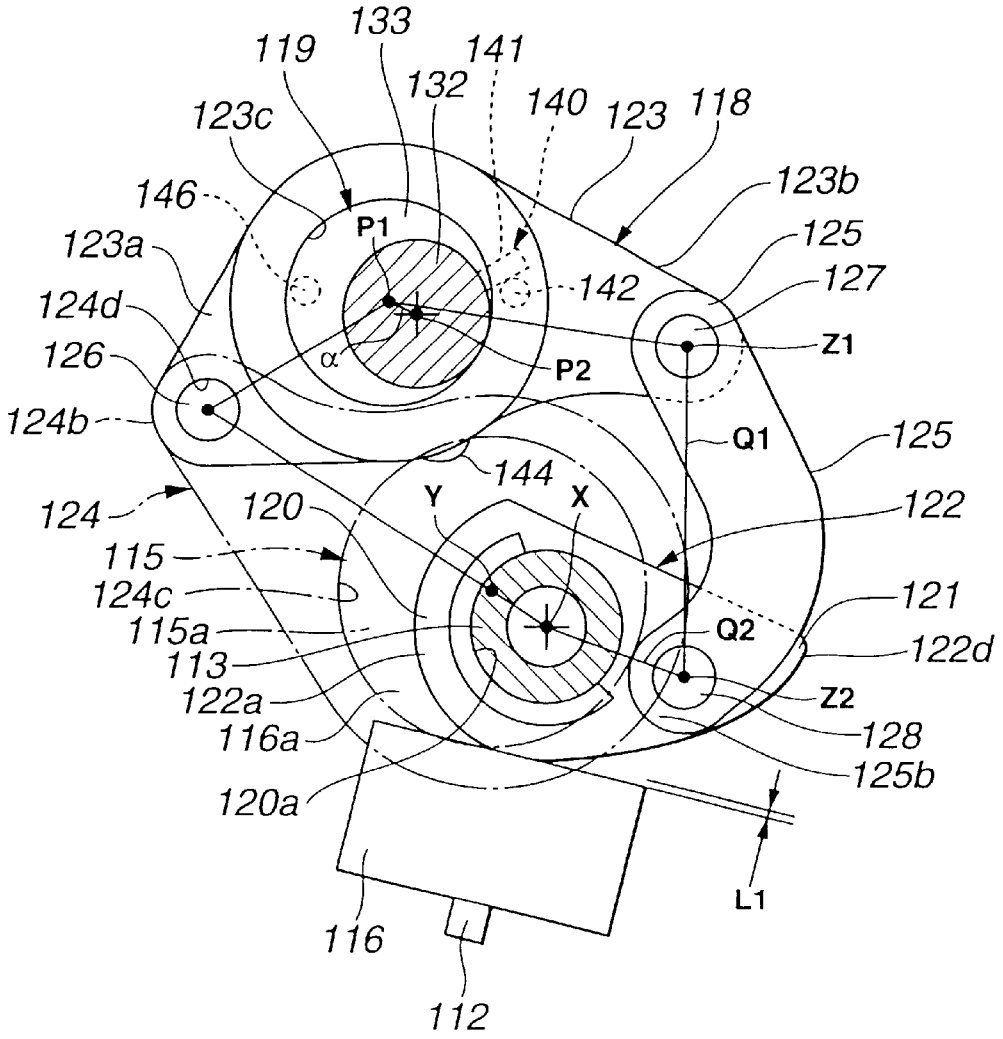
FIG. 16 is a view similar to FIG. 12, showing operation of the VVA apparatus when the engine is at low velocity and low load.

Referring to FIGS. 10 and 16, when rotation of the crank cam 115 pushes the first arm 123*a* of the rocker arm 123 upward through the crank arm 124, a valve lift L1, which is fully small as shown in FIGS. 10 and 16, is transmitted to the VO cam 117 and the valve lifter 116 through the link rod 125.

Figure 18:
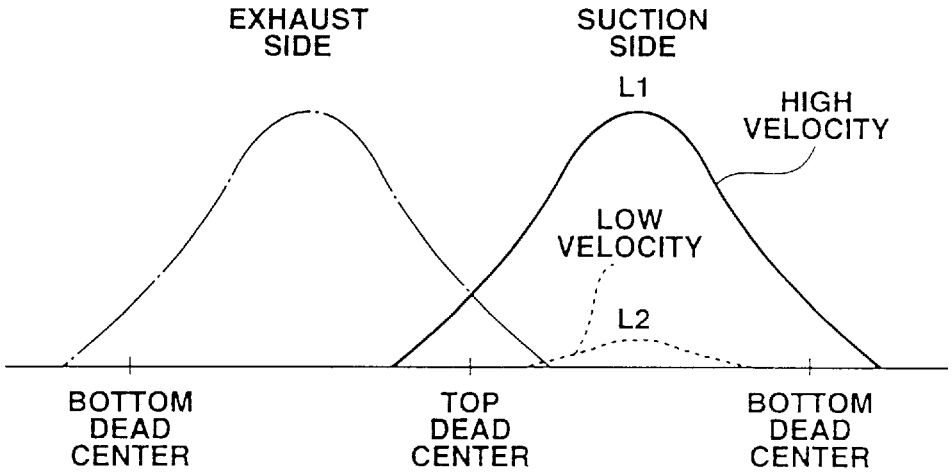
FIG. 18 is a view similar to FIG. 15, illustrating the relation between valve timing and valve lift.

Thus, in such low-velocity and low-load range, referring to FIG. 18, the intake valve 112 has smaller valve lift and delayed opening timing as shown by the broken line, resulting in small valve overlap with the exhaust valve. This allows improved fuel efficiency and stable engine rotation.

Further, during minimum valve-lift control, the control shaft 132 is held in the rotated position where excessive rotation is restricted by the stopper pin 141 coming in contact with the first stopper protrusion 142 as described above. Thus, the angle formed by the lines Q1, Q2 when the VO cam 117 jumps maximally is restricted to the angle $\theta_4$. This allows a sure prevention of locking between the VO cam 117 and the link rod 125 when the link rod 125 urges to rotate the VO cam 117 downward by eccentric torque of the crank cam 115. Thus, smooth operation of the VO cam 117 and the link rod 125 is obtained, resulting in smooth opening of the intake valve 112 during minimum valve-lift control.

Still further, the first restriction mechanism 140, having the stopper pin 141 coming in contact with the first stopper protrusion 142 as described above, serves to merely restrict further rotation of the control shaft 132, and not to directly restrict the rocking position of the VO cam 117 that rocks fiercely during engine operation. Thus, there is no occurrence of hammering due to interference of the VO cam 117 with a member for restricting the rocking position thereof, allowing the maintenance of silence.

Furthermore, when, after a long period of time of operation of the apparatus, the angle $\theta_4$ is increased due to abnormal wear of the stopper pin 141 and the first stopper protrusion 142, which causes a change in the position of contact between the two, or due to abnormal wear of slide portions even though no change occurs in the above position of contact, the second restriction mechanism 143 functions so that the VO cam 117 has the top face on the side of the cam nose 121 coming in contact with the second stopper protrusion 144 as shown by the two-dot chain line in FIG. 10, obtaining a restriction of further rocking motion thereof. Thus, the angle formed by the lines Q1, Q2 can be restricted to the angle $\theta_5$ that causes no locking between the VO cam 117 and the link rod 125, resulting in smooth operation of the intake valve 112 during a long period of time. Particularly, the second restriction mechanism 143 includes the second stopper protrusion 144 that can directly restrict excessive rocking motion of the VO cam 117, allowing a stable and sure prevention of locking between the VO cam 117 and the link rod 125.

On the other hand, when the engine is at high velocity and high load, the control shaft 132 is rotated counterclockwise by the actuator 134 in accordance with a control signal out of the controller 135 until the stopper pin 141 comes in contact with the third stopper protrusion 146. Thus, referring to FIGS. 17A–17B, the control shaft 132 rotates the control cam 133 counterclockwise from the position as shown in FIG. 16 to the first rotation-angle position, moving the axis P1 (thick portion 33*a*) downward. This moves the rocker arm 123 in the direction of the driving shaft 113 or downward in its entirety, which urges the second arm 123*b* to push the cam nose 121 of the VO cam 117 downward through the link rod 125, rotating clockwise the VO cam 117 in its entirety by a predetermined amount.

Figure 17B:
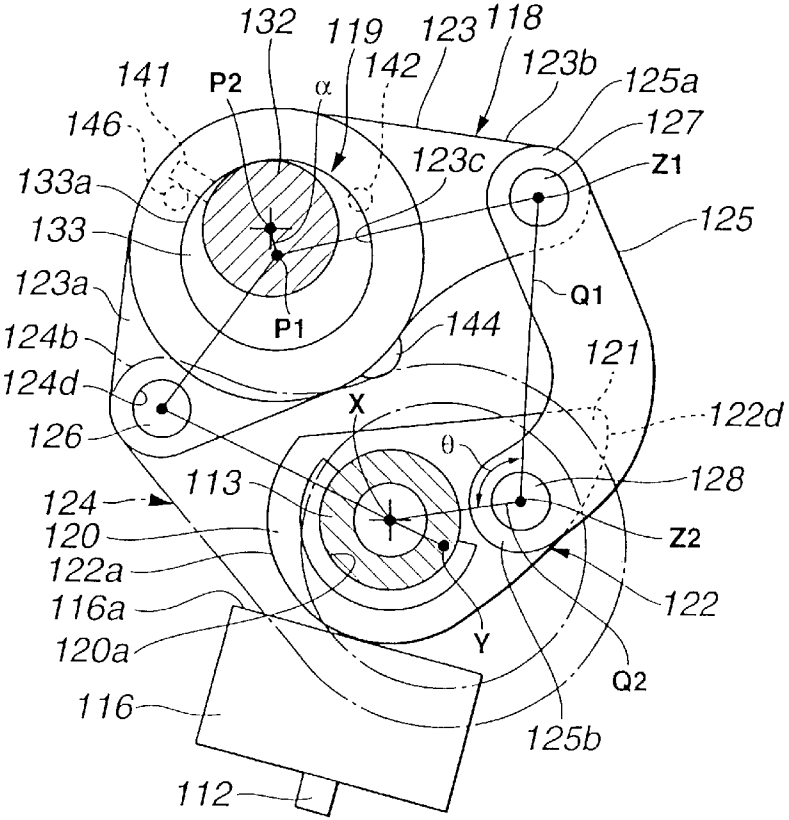
Figure 17A:
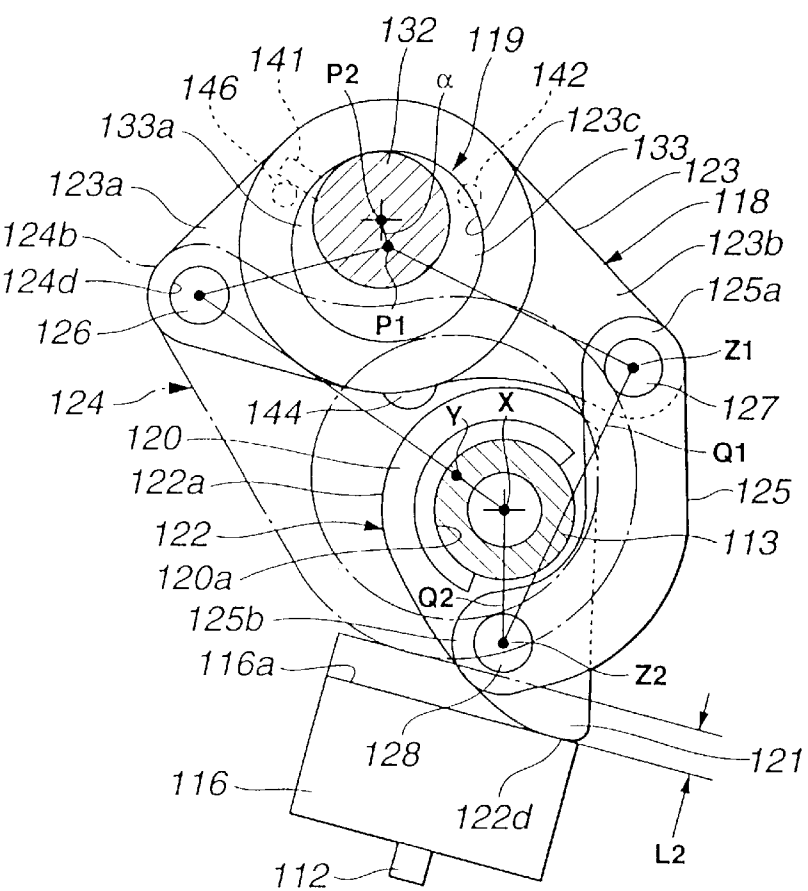

Therefore, the position of contact of the cam face 122 of the VO cam 117 with respect to the top face 116*a* of the valve lifter 116 is moved to the right or on the side of the top face 122*d* as shown in FIGS. 17A–17B. Thus, the crank cam 115 is rotated to push the first arm 123*a* of the rocker arm 123 upward through the crank arm 124, obtaining a large valve lift L2 with respect to the valve lifter 116 as shown in FIG. 17A.

In such high-velocity and high-load range, the cam-lift characteristic is larger as compared with the low-velocity and low-load range, obtaining larger valve lift and advanced opening timing and delayed closing timing of the intake valve 112 as shown by the full line in FIG. 18. This results in an improvement in intake-gas filling efficiency, ensuring full engine output.

During maximum valve-lift control also, the stopper pin 141 comes in contact with the third stopper protrusion 146 to allow a reduction in the angle formed by the lines Q1, Q2 when the VO cam 117 is largely rotated as shown in FIG. 17B, resulting in a sure prevention of locking between the VO cam 117 and the link rod 125.

Therefore, this cooperates with operation of the first restriction mechanism 140 to always ensure smooth opening of the intake valve 112 during minimum and maximum valve-lift controls, resulting in a prevention of lowered engine performance.

Further, under the normal service conditions, the VO cam 117 may not collide with the second stopper protrusion 144, having no occurrence of hammering, resulting in a maintenance of silence. If above abnormal wear is produced, hammering will occur, but locking can surely be prevented between the VO cam 117 and the link rod 125. It is to be noted that such hammering is useful to give warning to a driver.

Still further, in the second embodiment, the crank cam 115 and the VO cam 117 are mechanically linked with each other by the crank arm 124 and the link rod 125 through the rocker arm 123. Thus, excessive rocking motion or jumping of the VO cam 117 during engine high rotation can be restricted by the link rod 125, etc. This always ensures excellent link between the VO cam 117 and the crank cam 115, allowing a stable and sure prevention of above locking.

Figure 19:
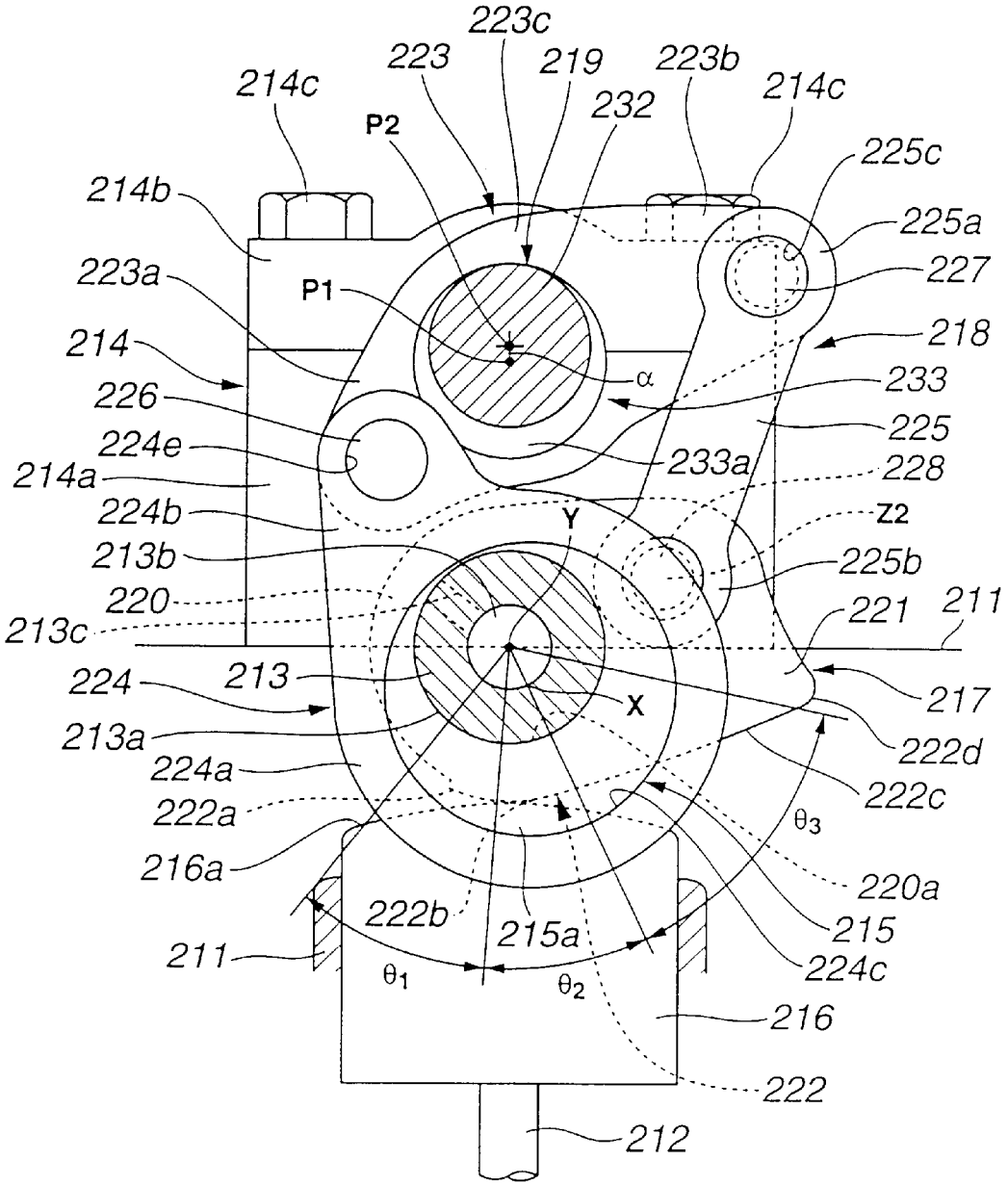
FIG. 19 is a view similar to FIGS. 17A–17B, taken along the line XIX—XIX in FIG. 20, showing a third embodiment of the present invention.
Figure 20:
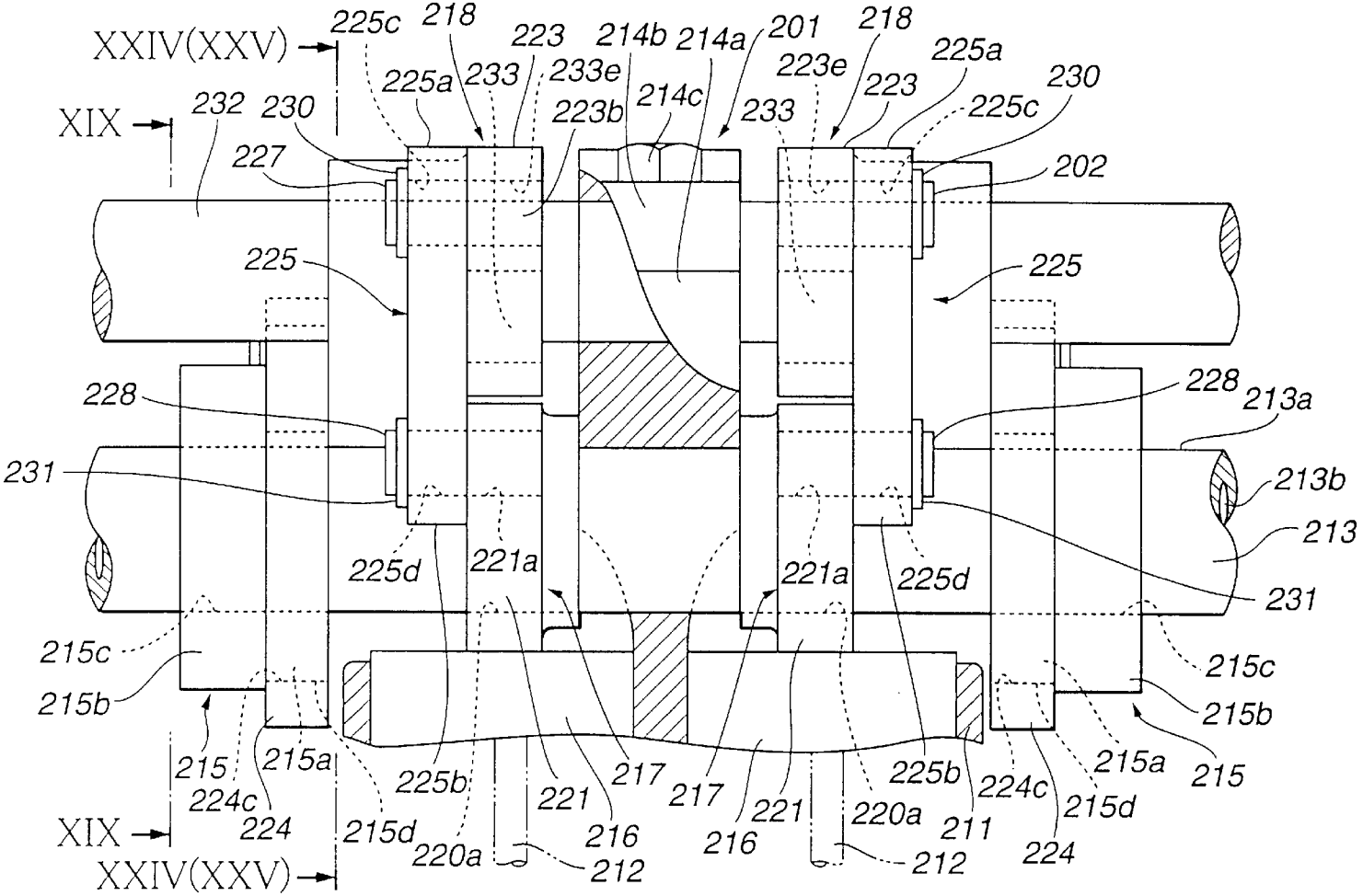
FIG. 20 is a view similar to FIG. 2, showing the VVA apparatus in FIG. 19.
Figure 21:
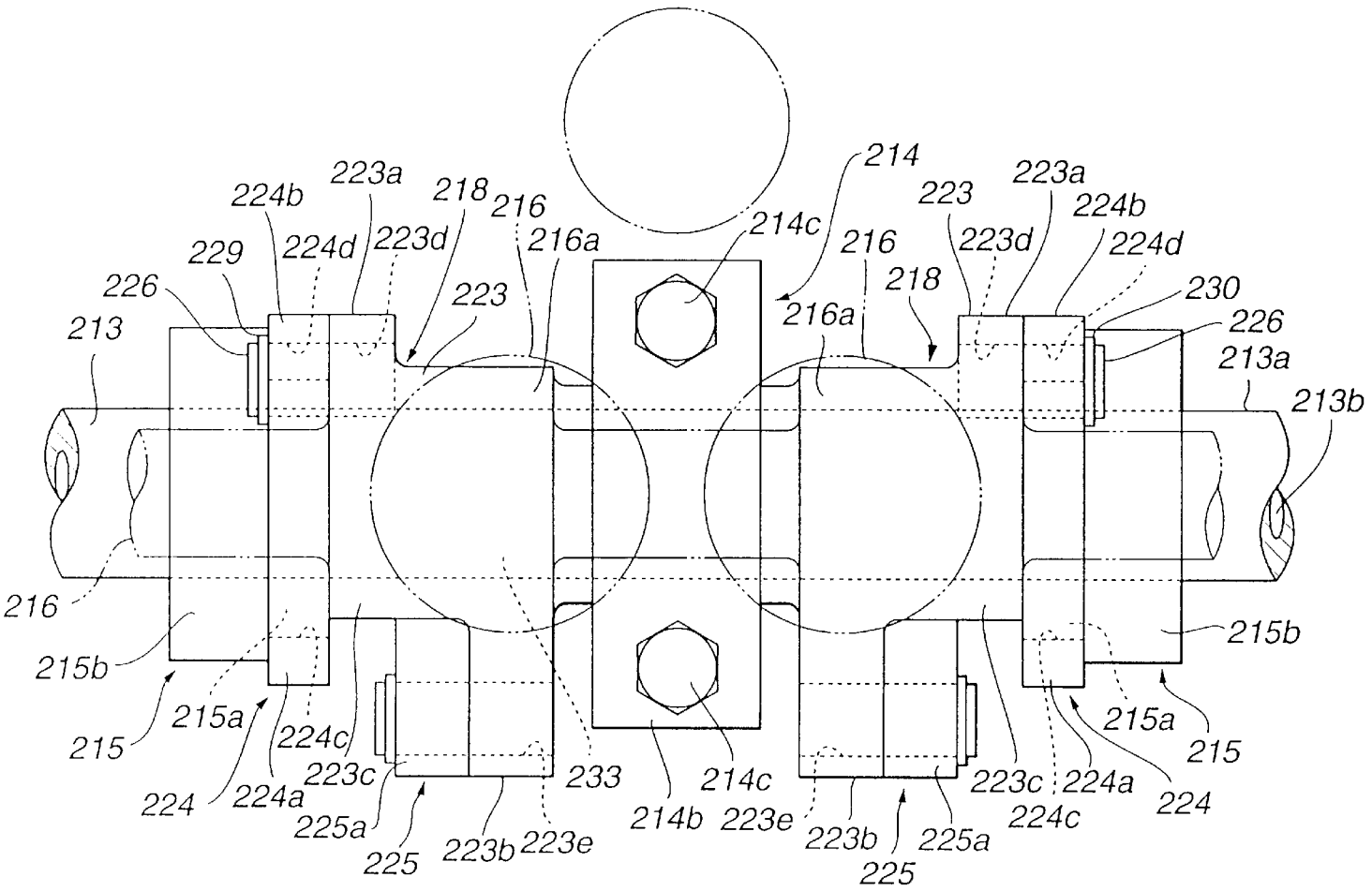
FIG. 21 is a view similar to FIG. 3, showing the VVA apparatus in FIG. 19.

FIGS. 19–26 show a third embodiment of the present invention. Referring to FIGS. 19–21, the VVA apparatus includes a pair of intake valves 212 slidably arranged with a cylinder head 211 through valve guides, not shown, a hollow driving shaft 213 rotatably supported by a bearing 214 arranged with the cylinder head 211 in the upper portion, a pair of drive or eccentric rotating cams 215 fixed to the driving shaft 213 through press fit, etc., a pair of VO cams 217 swingably supported on an outer peripheral surface 213*a* of the driving shaft 213 and coming in slide contact with valve lifters 216 disposed at the upper ends of the intake valves 212 to open them, a transmission mechanism 218 connected between the crank cams 215 and the VO cams 217 for transmitting torque of the crank cams 215 to the VO cams 217 as a rocker force, and an alteration mechanism 219 for altering the operating position of the transmission mechanism 218.

The driving shaft 213 extends in the longitudinal direction of the engine, and has one end with a follower sprocket, a timing chain wound thereon, etc. not shown, through which torque is received from a crankshaft of the engine. The driving shaft 213 is rotated counterclockwise as viewed in FIG. 19. The driving shaft 213 has an oil passage 213*b* formed axially to communicate with an oil main gallery, not shown, and hydraulic holes 213*c* formed radially, each having one end communicating with the hydraulic passage 213*b* and another end communicating with a clearance between an outer peripheral surface 213*a* of the driving shaft 213 and an inner peripheral surface of a support hole 220*a* of the VO cam 217 as will be described later.

The bearing 214 includes a main bracket 214*a* arranged at the upper end of the cylinder head 211 for supporting the upper portion of the driving shaft 213, and an auxiliary bracket 214*b* arranged at the upper end of the main bracket

214*a* for rotatably supporting a control or support shaft 232 as will be described later. The brackets 214*a*, 214*b* are fastened together from above by a pair of bolts 214*c*.

Figure 22:
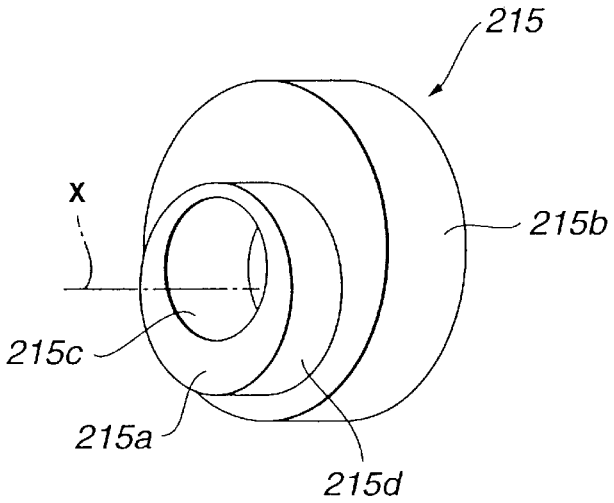
FIG. 22 is a view similar to FIG. 14, showing a crank cam used in the third embodiment.

Referring to FIG. 22, the crank cams 215 are formed substantially like a ring, each including a small-diameter main body 215*a* and a flange 215*b* integrated with the outer end face thereof. A though hole 215*c* is formed axially to receive the driving shaft 213. An axis Y of the main body 215*a* is offset with respect to an axis X of the driving shaft 213 in the radial direction by a predetermined amount. Moreover, the crank cams 215 are press fitted to the driving shaft 213 through the through hole 215*c* on the outer sides where no interference occurs with the valve lifters 216. The main bodies 215*a* have outer peripheral surfaces 215*d* formed in the same profile.

The valve lifters 216 are formed like a covered cylinder, each being slidably held in a hole of the cylinder head 211 and having a circular top face 216*a* formed in the cross direction of the engine, with which the VO cam 217 comes in slide contact.

Referring to FIGS. 19–21 and 24A–25B, the VO cam 217 is formed substantially like a letter U, and has the support hole 220*a* at a substantially annular base end 220, through which the driving shaft 213 is arranged for rotatable support. The VO cam 217 also has a pin hole 221*a* on the side of a cam nose 221. The lower side of the VO cam 217 is formed with a cam face 222 including a base-circle face 222*a* on the side of the base end 220, a ramp face 222*b* circularly extending from the base-circle face 222*a* to the cam nose 221, and a lift face 222*c* extending from the ramp face 222*b* to a top face 222*d* with the maximum lift arranged at an end of the cam nose 221. The base-circle face 222*a*, the ramp face 222*b*, the lift face 222*c*, and the top face 222*d* come in contact with predetermined points of the top face 216*a* of the valve lifter 216 in accordance with the rocking position of the VO cam 217.

Figure 23:
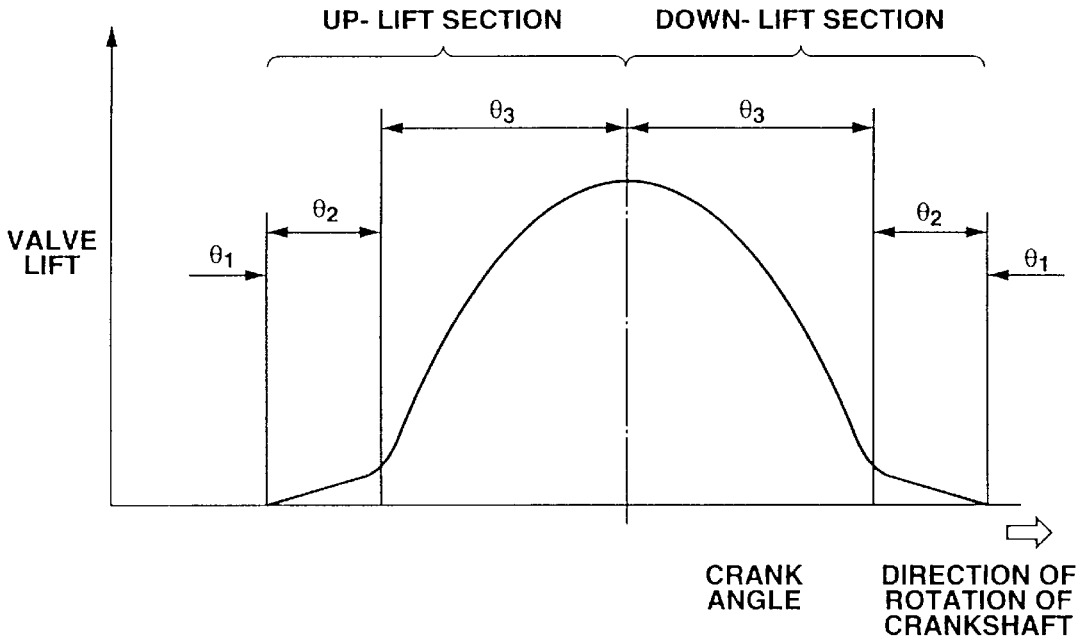
FIG. 23 is a view similar to FIG. 18, illustrating the relation between valve timing and valve lift.

Specifically, referring to FIG. 23, in view of the valve-lift characteristic, a predetermined angular range $\theta_1$ of the base-circle face 222*a* corresponds to a base-circle section, and a predetermined angular range $\theta_2$of the ramp face 222*b* subsequent to the base-circle section $\theta_1$ corresponds to a ramp section, and a predetermined angular range $\theta_3$ of the ramp face 222*b* from the ramp section $\theta_2$ to the top face 222*d* corresponds to a lift section.

The transmission mechanism 218 includes a rocker arm 223 disposed above the driving shaft 213, a crank arm 224 for linking a first arm 223*a* of the rocker arm 223 with the crank cam 215, and a link rod 225 for linking a second arm 223*b* of the rocker arm 223 with the VO cam 217.

Referring to FIG. 21, the VO cam 223 is formed substantially like a crank as viewed in a plan, and has in the center a cylindrical base 223*c* rotatably supported by a control cam 233 as will be described later. The first arm 223*a* protruding from an outer end of the cylindrical base 223*c* has a pin hole 223d for receiving a pin 226, whereas the second arm 223*b* protruding from an inner end of the cylindrical base 223*c* has a pin hole 223*e* for receiving a pin 227 for connecting the second arm 223*b* and a first end 225*a* of the link rod 225.

The crank arm 224 includes a relatively-large-diameter annular base 224*a* and an extension 224*b* arranged in a predetermined position of the outer peripheral surface of the base 224*a*. The base 224*a* has in the center an engagement hole 224*c* rotatably engaged with the outer peripheral surface of the main body 215*a* of the crank cam 215. The extension 224*b* has a pin hole 224*d* for rotatably receiving the pin 226.

As best seen in FIG. 19, the link rod 225 is formed like a straight line with a predetermined length, and has first and second ends 225*a*, 225*b* formed with pin holes 225*c*, 225*d* through which ends of the pins 227, 228 press fitted in the pin holes 223*e*, 221*a* of the second arm 223*b* of the rocker arm 223 and the cam nose 221 of the VO cam 217 are rotatably arranged. An axis Z2 of the pin 228 forms a rocking fulcrum of the VO cam 217.

Figure 25B:
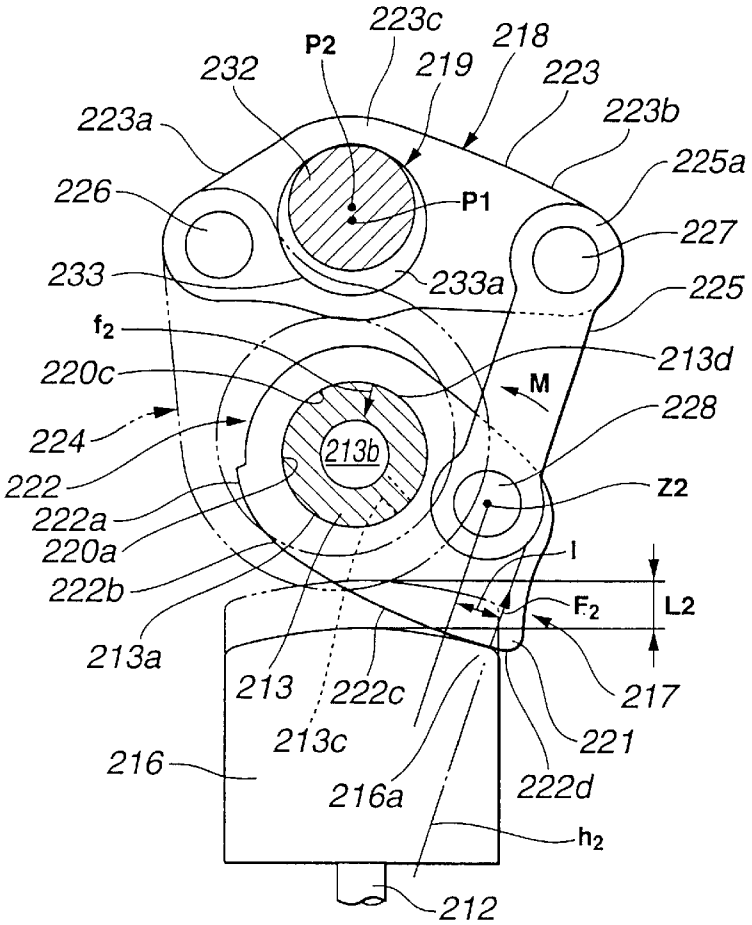
FIGS. 25A–25B are views similar to FIGS. 24A–24B, taken along the line XXV—XXV in FIG. 20, showing operation of the VVA apparatus when the engine is at high velocity and high load.
Figure 25A:
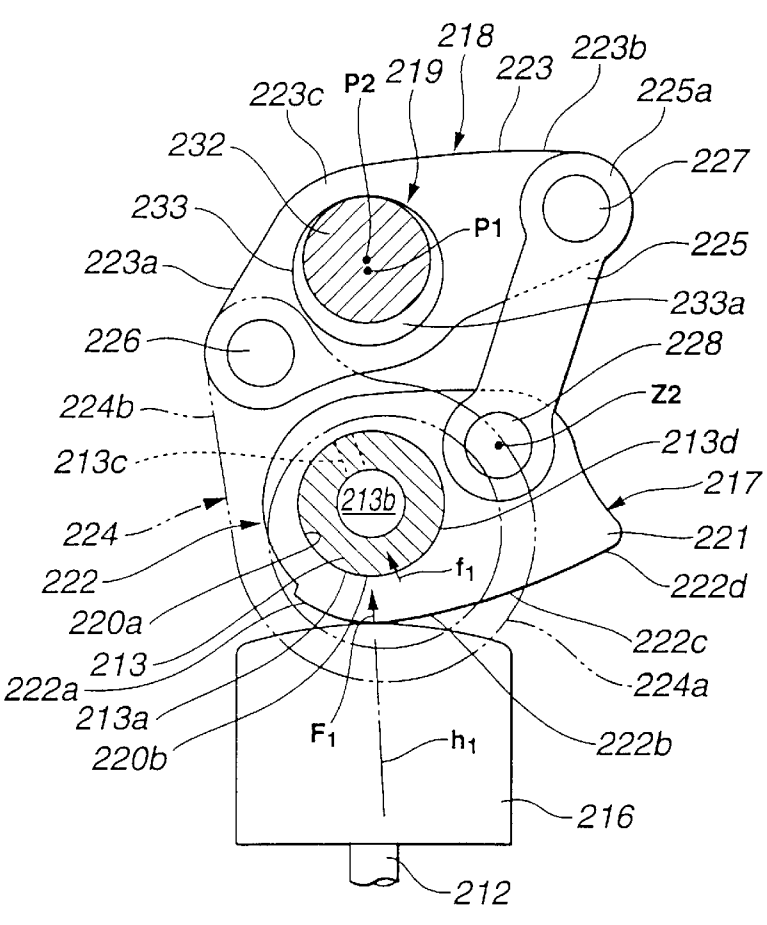

Referring to FIGS. 25A–25B, due to circular formation of the top face 216*a* of the valve lifter 216, the position of a normal corresponding to the direction of a reaction force of a valve spring that acts on the point of contact between the VO cam 217 and the valve lifter 216 during rotation of the crank cam 215 is changed between a first position near the driving shaft 213 and a second position opposite thereto with respect to the axis Z2 of the pin 228 in the maximum valve-lift range of the intake valve 212. Specifically, in the base-circle range of the VO cam 217, as shown in FIG. 25A, a normal hi of a reaction force $F_1$ of the valve spring extends vertically or in the axial direction of a valve stem of the intake valve 212, and is positioned near the driving shaft 213 with respect to the axis Z2. In the lift range of the VO cam 217, as shown in FIG. 25B, a normal $h_2$ of a reaction force $F_2$ of the valve spring is positioned opposite to the driving shaft 213 with respect to the axis Z2 and at a distance I therefrom, since the VO cam 217 comes in contact with the outer peripheral edge of the valve lifter 216.

Figure 24B:
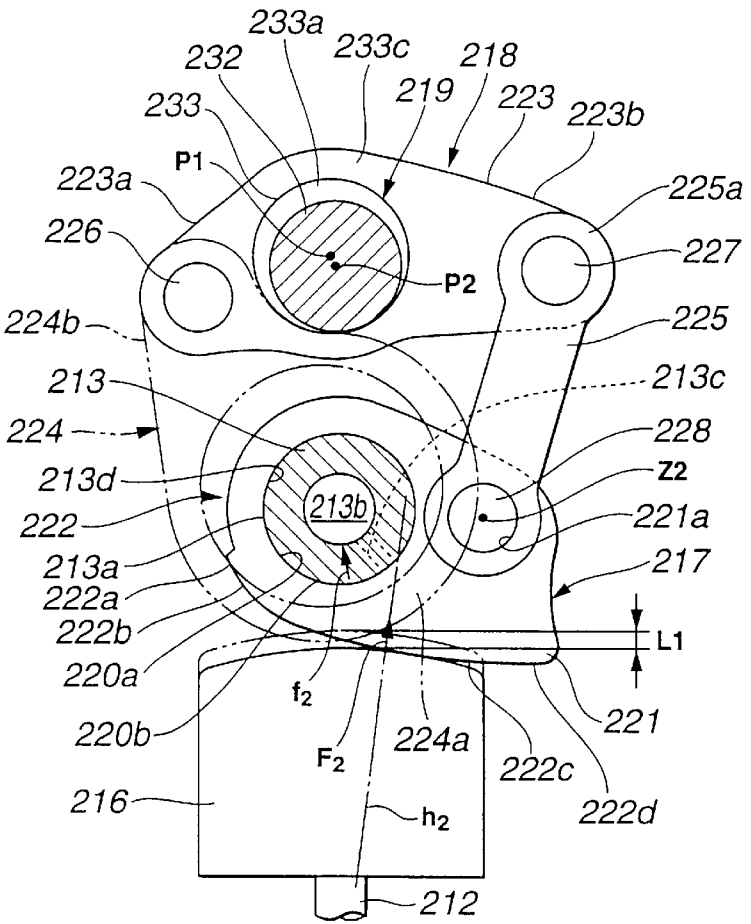
FIGS. 24A–24B are views similar to FIG. 19, taken along the line XXIV—XXIV in FIG. 20, showing operation of the VVA apparatus when the engine is at low velocity and low load.
Figure 24A:
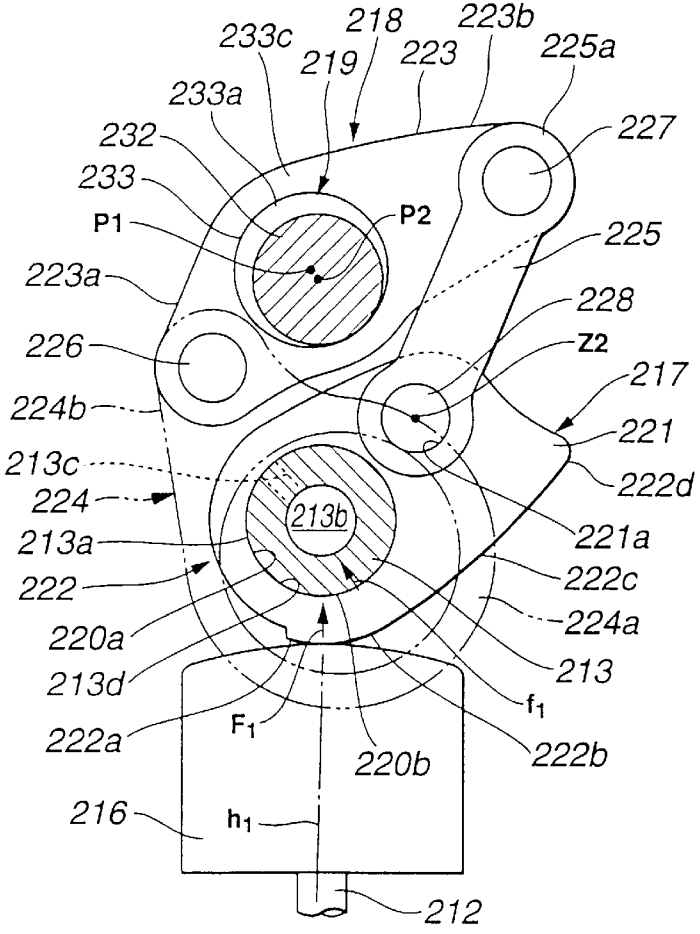

On the other hand, in the small rotation-angle range of the intake valve 212, as shown in FIGS. 24A–24B, since the VO cam 217 always comes in contact with substantially the center of the top face 216*a* of the valve lifter 216, the normals $h_1$, $h_2$ are positioned near the driving shaft 213 with respect to the axis Z2.

Arranged at one ends of the pins 226, 227, 228 are snap rings 229, 230, 231 for restricting axial movement of the crank arm 224 and the link rod 225.

The alteration mechanism 219 includes the control shaft 232 rotatably supported by the bearing 214 above the driving shaft 213 and the control cam 233 fixed on the outer periphery of the control shaft 232 for forming a rocking fulcrum of the rocker arm 223.

The control cam 233 is formed like a cylinder, and has an axis P1 eccentric to an axis P2 of the control shaft 232 by an amount $\alpha$ corresponding to a thick portion 233*a* as shown in FIG. 19.

The control shaft 232 is disposed parallel to the driving shaft 213 and in the longitudinal direction of the engine to be rotatable within a predetermined range of angle of rotation by an electromagnetic actuator, not shown, arranged at one end. The actuator is driven in accordance with a control signal out of a controller, not shown, for determining the engine operating conditions. The controller determines the actual engine operating conditions in accordance with detection signals out of various sensors such as a crank angle sensor, an air flow meter and a coolant temperature sensor to output a control signal to the actuator.

Next, operation of the third embodiment will be described. When the engine is at low velocity and at low load, the control shaft 232 is rotated clockwise by the actuator in accordance with a control signal out of the controller. This moves the thick portion 233*a* of the control cam 233 upward with respect to the driving shaft 213, so that the axis P1 of the control cam 233 is kept in a second rotation-angle position located in the top left direction of the axis P2 of the control shaft 232 as shown in FIGS. 24A–24B. Thus, the rocker arm 223 is moved upward with respect to the driving shaft 213, so that the VO cam 217, having the cam nose 221 forcibly drawn up through the link rod 225, is rotated counterclockwise in its entirety.

Referring to FIGS. 24A–24B, when rotation of the crank cam 215 pushes the first arm 223*a* of the rocker arm 223 upward through the crank arm 224, a valve lift L1, which is fully small as shown in FIG. 24B, is transmitted to the VO cam 217 and the valve lifter 216 through the link rod 225.

Figure 26:
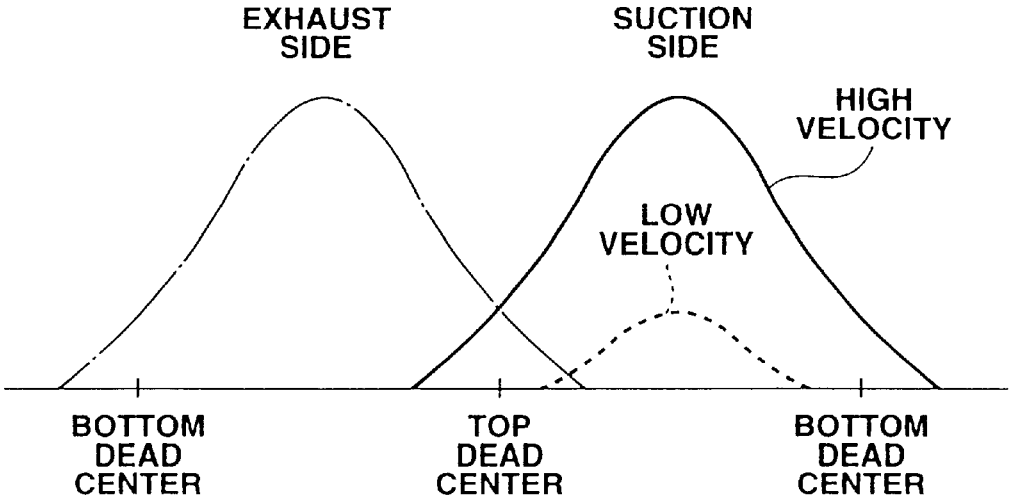
FIG. 26 is a view similar to FIG. 23, showing the relation between valve timing and valve lift.

Thus, in such low-velocity and low-load range, referring to FIG. 26, the intake valve 212 has smaller valve lift and delayed opening timing as shown by the broken line, resulting in small valve overlap with the exhaust valve. This allows improved fuel efficiency and stable engine rotation.

In the small-valve-lift range, the normals $h_1$, $h_2$ of the reaction forces $F_1$, $F_2$ of the valve spring are positioned near the driving shaft 213 with respect to the axis Z2, so that forces $f_1$, $f_2$ acting, from the inner peripheral surface of the support hole 220*a* of the VO cam 217, on the outer peripheral surface 213*a* of the driving shaft 213 are applied to the whole area of a lower end 220*b* of the inner peripheral surface and a lower end 213*d* of the outer peripheral surface 213*a*. However, at that time, due to small valve lift of the VO cam 217, a reaction farce of the valve spring is small, having less occurrence of wear between the lower ends 220*b*, 213*d*. Moreover, at that time, the normals $h_1$, $h_2$ are moved only within the rocking-fulcrum-side range of the VO cam 217, resulting in achievement of smaller valve lift.

On the other hand, when the engine is at high velocity and high load, the control shaft 232 is rotated counterclockwise by the actuator in accordance with a control signal out of the controller. Thus, referring to FIGS. 25A–25B, the control shaft 232 rotates the control cam 233 counterclockwise from the position as shown in FIGS. 24A–24B, moving the axis P1 (thick portion 33*a*) downward. This moves the rocker arm 223 in the direction of the driving shaft 213 or downward in its entirety, which urges the second arm 223*b* to push the cam nose 221 of the VO cam 217 downward through the link rod 225, rotating clockwise the VO cam 217 in its entirety by a predetermined amount.

Therefore, the position of contact of the cam face 222 of the VO cam 217 with respect to the top face 216*a* of the valve lifter 216 is moved to the right or on the side of the top face 222*d* as shown in FIGS. 25A–25B. Thus, the crank cam 215 is rotated as shown in FIG. 25A to push the first arm 223*a* of the rocker arm 223 upward through the crank arm 224, obtaining a large valve lift L2 with respect to the valve lifter 216 as shown in FIG. 25B.

In such high-velocity and high-load range, the cam-lift characteristic is larger as compared with the low-velocity and low-load range, obtaining larger valve lift and advanced opening timing and delayed closing timing of the intake valve 212 as shown by the full line in FIG. 26. This results in an improvement in intake-gas filling efficiency, ensuring full engine output.

Moreover, referring to FIG. 25B, in the large-valve-lift range or the range of large reaction force of the valve spring, the position of contact of the cam face 222 with respect to the top face 216*a* of the valve lifter 216 is located near the edge of the top face 216*a* in the vicinity of the maximum lift. Thus, the normal $h_1$ of the reaction force F2 of the valve spring is positioned outside with respect to the axis Z2, i.e. opposite to the driving shaft 213 with respect thereto. Therefore, the VO cam 217 is subjected to a counterclockwise moment M about the axis Z2 in its entirety, and is pushed downward by the load $f_2$. Thus, the load acting direction is reversed such that an upper end 220*c* of the inner peripheral surface of the support hole 220*a* comes in slide contact with an upper end 213*e* of the outer peripheral surface 213*a* of the driving shaft 213.

This prevents the lower end 220*b* of the inner peripheral surface of the support hole 220*a* from coming in slide contact with the lower end 213*d* of the outer peripheral surface 213*a* of the driving shaft 213, having no occurrence of local heat generation and wear of the lower ends 220*b*, 213*d*.

Further, lubricating oil is supplied between the inner peripheral surface of the support hole 220*a* and the outer peripheral surface 213*a* of the driving shaft 213, having improved lubrication performance of the two surfaces. Still further, upon above load reversion, there produce not only a so-called restricted-film effect of lubricating oil, which contributes to an improvement in the load performance of lubricating oil, but a forced supply thereof to a contact portion between the two surfaces, which allows a further prevention of occurrence of wear therebetween.

Furthermore, the VO cam 217 has a rocking range restricted by the transmission mechanism 218, particularly, by the link rod 225, allowing a restriction of excessive rocking motion even at high rocking speed during high rotation of the engine, etc.

Figure 27:
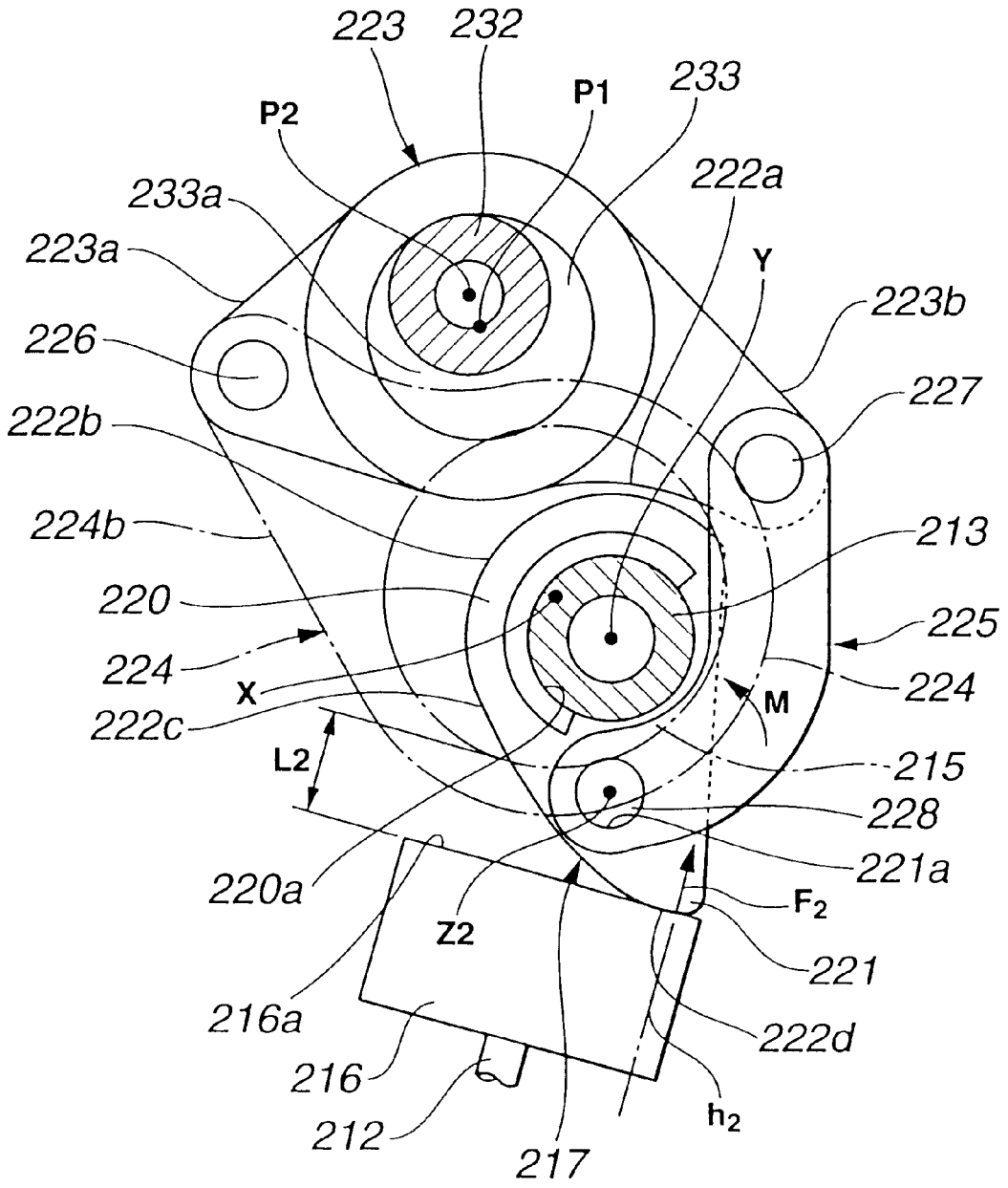
FIG. 27 is a view similar to FIGS. 25A–25B, showing a fourth embodiment of the present invention.

FIG. 27 shows a fourth embodiment of the present invention that is substantially the same as the third embodiment except that the link rod 225 is formed like a circular arc having a concave on the side of the driving shaft 213, and the top face 216*a* of the valve lifter 216 is formed flat. Circular formation of the link rod 225 allows the normal $h_2$ of the reaction force $F_2$ of the valve spring to be positioned outside with respect to the axis Z2 in the maximum valve-lift range of the intake valve 212 in the same way as the third embodiment.

Therefore, the fourth embodiment produces an effect of preventing an occurrence of local wear between the outer peripheral surface 213*a* of the driving shaft 213 and the inner peripheral surface of the support hole 220a of the VO cam 217.

Figure 28:
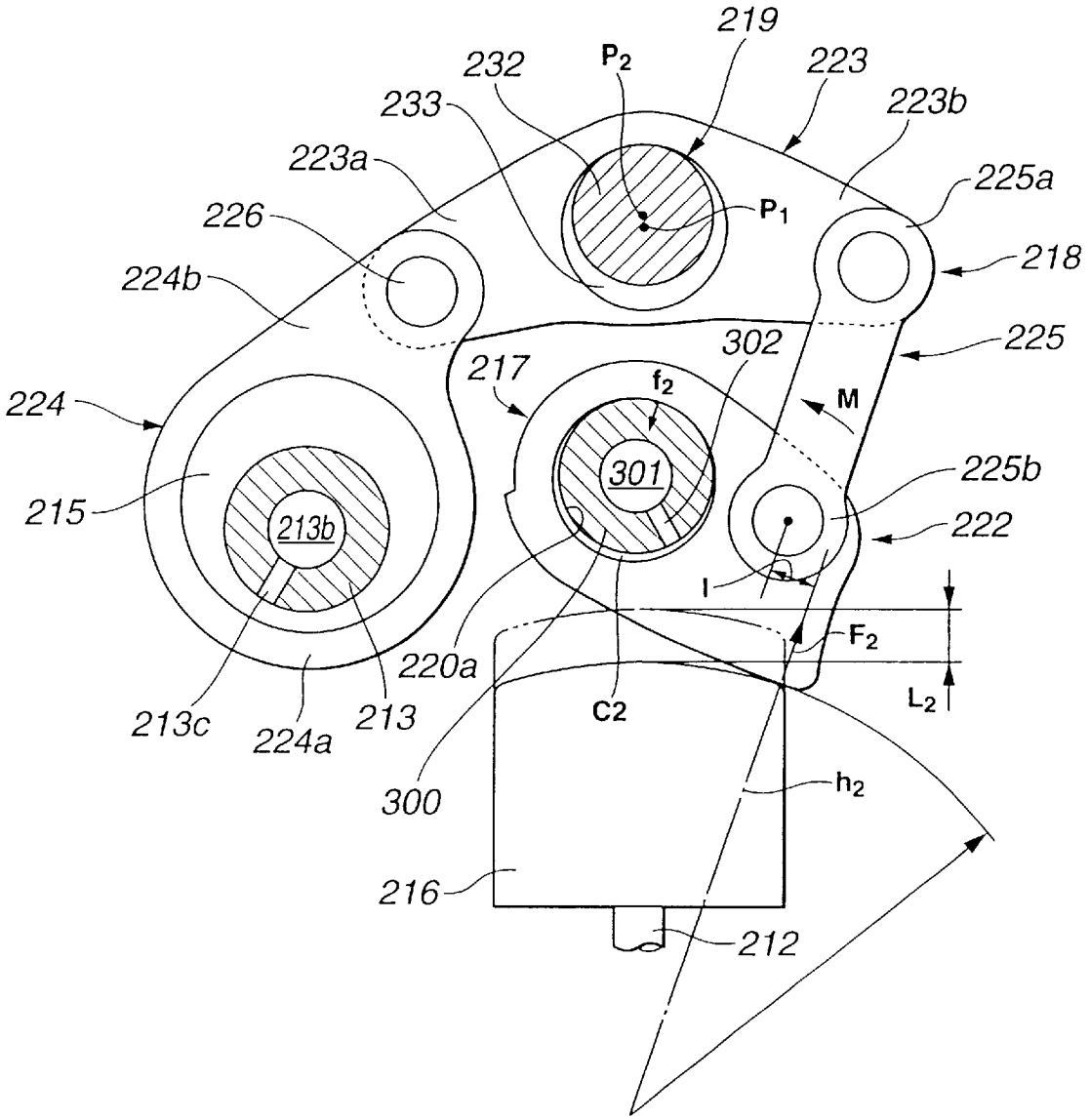
FIG. 28 is a view similar to FIG. 27, showing a fifth embodiment of the present invention.

FIG. 28 shows a fifth embodiment of the present invention that is substantially the same as the third embodiment. In the fifth embodiment, the VO cam 217 is supported by a support shaft 300 that is a member different from the driving shaft 213. Moreover, the support shaft 300 has an oil passage 301 formed axially, and an oil hole 302 formed radially and having one end communicating with the support hole 220*a* of the VO cam 217.

In the fifth embodiment, the force f2 out of the VO cam 217 does not act on the driving shaft 213, preventing local wear of the driving shaft 213, resulting in improved durability thereof. As for the support shaft 300, the wear resistance is improved on the same principle as that described in the third embodiment.

Having described the present invention with regard to the preferred embodiments, it is noted that the present invention is not limited thereto, and various changes and modifications can be made without departing from the scope of the present invention. By way of example, in the case of engines with lower maximum valve-lift requirements, referring to FIG. 9, the maximum valve-lift position So may slightly be displaced on the normal-rotation side $\theta_1'$ with respect to $\theta_1$. Further, the restriction mechanism may be constructed to restrict excessive upward motion of the second arm of the rocker arm. Still further, the present invention is applicable to VVA apparatus with no alteration mechanism. Furthermore, the present invention is applicable to the exhaust valve.

What is claimed is:

1. A variable-valve-actuation apparatus for an internal combustion engine with a cylinder head, a crankshaft and a valve, comprising:

a driving shaft rotated in synchronism with the crankshaft, said driving shaft including a crank cam on an outer periphery;

a control shaft arranged substantially parallel to said driving shaft;

a valve lifter movably arranged with respect to the cylinder head, said valve lifter including a top face;

a valve operating (VO) cam swingably supported by said driving shaft, said VO cam opening and closing the valve through said valve lifter, said VO cam including a cam face;

a crank arm including a base and an extension, said base being slidably engaged with an outer periphery of said crank cam;

a rocker arm including first and second arms, said first arm being rotatably connected to said extension of said crank arm, which forms a first pivotal point;

a link rod having a first end rotatably connected to an end of said VO cam, which forms a second pivotal point, and a second end rotatably connected to said second arm of said rocker arm, which forms a third pivotal point; and a control cam mounted to said control shaft on an outer periphery, said control cam having an axis eccentric to an axis of said control shaft, said control cam changing a rocking fulcrum of said rocker arm in accordance with a rotated position of said control shaft, whereby a position of contact of said cam face of said VO cam with respect to said top face of said valve lifter is changed in accordance with a change in said rocking fulcrum of said rocker arm to alter a lift of the valve, wherein a maximum lift of the valve is obtained in a first rotated position of said control shaft where said axis of said control cam is adjacent to said driving shaft, wherein a minimum lift of the valve is obtained in a second rotated position of said control shaft where said axis of said control cam is positioned near said first pivotal point of said rocker arm and said crank arm with respect to a first line connecting said axis of said control shaft and said axis of said control cam upon said maximum lift.

2. A variable-valve-actuation apparatus as claimed in claim 1, wherein said minimum lift is obtained by rotating said axis of said control cam from a first position upon said maximum lift to a second position on the side of said pivotal point of said rocker arm and said crank arm by a predetermined angle of rotation.

3. A variable-valve-actuation apparatus as claimed in claim 1, further comprising a first restriction mechanism restricting an angle formed by a second line connecting an axis of said driving shaft during lift control of the valve and said second pivotal point of said link rod and said VO cam and a third line connecting said second pivotal point and said third pivotal point of said rocker arm and said link rod to less than a first predetermined angle.

4. A variable-valve-actuation apparatus as claimed in claim 3, wherein said first restriction mechanism comprises a stopper defining a maximally rotated position of said control shaft in one direction.

5. A variable-valve-actuation apparatus as claimed in claim 3, further comprising a second restriction mechanism arranged between said VO cam and said rocker arm, said second restriction mechanism restricting said angle to a second predetermined angle greater than said first predetermined angle of said first restriction mechanism.

6. A variable-valve-actuation apparatus as claimed in claim 1, wherein the direction of a reaction force of a valve spring acting on a point of contact between said valve lifter and said VO cam during one rotation of said crank cam is changed between a third position near said driving shaft with respect to said second pivotal point and a fourth position opposite to said driving shaft with respect to said second pivotal point.

7. A variable-valve-actuation apparatus as claimed in claim 1, further comprising an alteration mechanism altering said rocking fulcrum of said rocker arm in accordance with operating conditions of the engine.

8. A variable-valve-actuation apparatus as claimed in claim 7, wherein said driving shaft has an oil passage formed axially, and an oil hole formed radially for hydraulic communication between said oil passage and an inner peripheral surface of a support hole of said VO cam.

9. A variable-valve-actuation apparatus as claimed in claim 8, wherein said t op face of said valve lifter is formed like a circular arc.

10. A variable-valve-actuation apparatus as claimed in claim 1, wherein said link rod is formed like a letter L having a concave on the side of said rocker arm.

11. A variable-valve-actuation apparatus for an internal combustion engine with a cylinder head, a crankshaft and a valve, comprising:

a driving shaft rotated in synchronism with the crankshaft, said driving shaft including a crank cam on an outer periphery;

a valve lifter movably arranged with respect to the cylinder head, said valve lifter including a top face;

a valve operating (VO) cam swingably supported by said driving shaft, said VO cam opening and closing the valve through said valve lifter, said VO cam including a cam face;

a rocker arm including first and second arms, said first arm being mechanically connected to said crank cam;

a link rod having a first end rotatably connected to an end of said VO cam, which forms a first pivotal point, and a second end rotatably connected to said second arm of said rocker arm, which forms a second pivotal point;

an alteration mechanism altering a rocking fulcrum of said rocker arm in accordance with operating conditions of the engine; and a restriction mechanism restricting an angle formed by a first line connecting an axis of said driving shaft during lift control of the valve and said first pivotal point of said link rod and said VO cam and a second line connecting said first pivotal point and said second pivotal point of said rocker arm and said link rod to less than a first predetermined angle, whereby a position of contact of said cam face of said VO cam with respect to said top face of said valve lifter is changed in accordance with a change in said rocking fulcrum of said rocker arm to alter a lift of the valve.

12. A variable-valve-actuation apparatus for an internal combustion engine with a cylinder head, a crankshaft and a valve, comprising:

a driving shaft rotated in synchronism with the crankshaft, said driving shaft including a crank cam on an outer periphery;

a valve lifter movably arranged with respect to the cylinder head, said valve lifter including a top face;

a transmission mechanism having one end slidably connected to said crank cam and another end; and a valve operating (VO) cam swingably supported by said driving shaft, said VO cam having an end rotatably connected to said another end of said transmission mechanism, which forms a pivotal point, said VO cam opening and closing the valve through said valve lifter, wherein the direction of a reaction force of a valve spring acting on a point of contact between said valve lifter and said VO cam during one rotation of said crank cam is changed between a first position near said driving shaft with respect to said pivotal point and a second position opposite to said driving shaft with respect to said second pivotal point.

13. A variable-valve-actuation apparatus for an internal combustion engine with a cylinder head, a crankshaft and a valve, comprising:

a driving shaft rotated in synchronism with the crankshaft, said driving shaft including a crank cam on an outer periphery;

a support shaft arranged parallel to said driving shaft;

a valve lifter movably arranged with respect to the cylinder head, said valve lifter including a top face;

a transmission mechanism having one end slidably connected to said crank cam and another end; and a valve operating (VO) cam swingably supported by said support shaft, said VO cam having an end rotatably connected to said another end of said transmission mechanism, which forms a pivotal point, said VO cam opening and closing the valve through said valve lifter, wherein the direction of a reaction force of a valve spring acting on a point of contact between said valve lifter and said VO cam during one rotation of said crank cam is changed between a first position near said driving shaft with respect to said pivotal point and a second position opposite to said driving shaft with respect to said second pivotal point.

* * * * *